US009211756B2

(12) United States Patent
Ballot

(10) Patent No.: US 9,211,756 B2
(45) Date of Patent: Dec. 15, 2015

(54) LIQUID APPLICATOR DEVICE

(75) Inventor: Stephan M. Ballot, Barrington Hills, IL (US)

(73) Assignee: Flocon Inc., Cary, IL (US)

( * ) Notice: Subject to any disclaimer, the term of this patent is extended or adjusted under 35 U.S.C. 154(b) by 931 days.

(21) Appl. No.: 13/068,261

(22) Filed: May 6, 2011

(65) Prior Publication Data

US 2012/0003027 A1 Jan. 5, 2012

Related U.S. Application Data

(60) Provisional application No. 61/343,981, filed on May 6, 2010.

(51) Int. Cl.

| | |
|---|---|
| ***B65D 47/24*** | (2006.01) |
| ***B43K 8/00*** | (2006.01) |
| ***B08B 1/00*** | (2006.01) |
| ***B43K 1/00*** | (2006.01) |
| ***B43K 23/12*** | (2006.01) |
| ***B43K 29/00*** | (2006.01) |
| ***B43M 11/06*** | (2006.01) |
| ***B65D 47/42*** | (2006.01) |
| ***B65D 51/32*** | (2006.01) |
| *A46B 5/00* | (2006.01) |
| *A46B 11/00* | (2006.01) |

(52) U.S. Cl.

CPC ..... *B43K 8/00* (2013.01); *A46B 11/001* (2013.01); *B08B 1/00* (2013.01); *B43K 1/00* (2013.01); *B43K 23/12* (2013.01); *B43K 29/00* (2013.01); *B43M 11/06* (2013.01); *B65D 47/248* (2013.01); *B65D 47/42* (2013.01); *B65D 51/32* (2013.01); *A46B 5/0016* (2013.01); *A46B 11/0006* (2013.01)

(58) Field of Classification Search

CPC ..... B65D 47/20; B65D 47/24; B65D 47/42; B65D 47/248

USPC ..... 401/16, 25, 27, 261, 263, 264, 260, 401/258, 259; 222/501, 518

See application file for complete search history.

(56) References Cited

U.S. PATENT DOCUMENTS

| | | | | |
|---|---|---|---|---|
| 1,062,576 | A * | 5/1913 | Baskett et al. | 222/501 |
| 1,424,862 | A * | 8/1922 | Vredenburgh | 222/501 |
| 1,857,467 | A | 5/1932 | Marsh | |

(Continued)

FOREIGN PATENT DOCUMENTS

| | | |
|---|---|---|
| FR | 995150 | 6/1949 |
| NL | 1016153 | 3/2002 |

*Primary Examiner* — David Walczak
*Assistant Examiner* — Bradley Oliver
(74) *Attorney, Agent, or Firm* — Frijouf, Rust & Pyle, P.A.

(57) ABSTRACT

A liquid applicator device is disclosed for applying a liquid from a container to a surface. A closure defining a closure aperture is secured the closure to the container. A sealing member sealingly engages with the closure mounting. The sealing member has a tubular sleeve with an applicator slidably disposed within the tubular sleeve. The applicator comprises a hollow interior with an applicator tip defined by an outer applicator portion of the applicator. A biasing member coacts between the closure and the applicator for urging the applicator to form a seal with the sealing member. A depression of the outer applicator portion against the surface displaces the applicator from the sealing member to enable the flow of the liquid from the container to the applicator tip of the applicator.

14 Claims, 13 Drawing Sheets

(56) References Cited

U.S. PATENT DOCUMENTS

| | | | | | |
|---|---|---|---|---|---|
| 2,024,413 | A | | 12/1935 | Witt | |
| 2,104,638 | A | | 1/1938 | Cuthbert | |
| 2,210,662 | A | | 8/1940 | Garvey | |
| 2,330,053 | A | | 9/1943 | Herb | |
| 2,611,916 | A | | 9/1952 | Prokop et al. | |
| 2,716,250 | A | | 8/1955 | Deakers | |
| 3,468,611 | A | | 9/1969 | Ward | |
| 3,484,027 | A | | 12/1969 | Micallef | |
| 3,540,636 | A | * | 11/1970 | Dvoracek | 401/260 |
| 3,565,294 | A | * | 2/1971 | Schwartzman | 401/206 |
| 3,661,468 | A | * | 5/1972 | Schwartzman | 401/206 |
| 3,680,968 | A | * | 8/1972 | Schwartzman et al. | 401/260 |
| 3,832,071 | A | * | 8/1974 | Chaney | 401/260 |
| 4,569,612 | A | | 2/1986 | Schwartzman et al. | |
| 4,685,820 | A | | 8/1987 | Kremer et al. | |
| 4,761,090 | A | | 8/1988 | Goh | |
| 4,792,252 | A | | 12/1988 | Kremer et al. | |
| 4,812,071 | A | * | 3/1989 | Batra et al. | 401/264 |
| 4,848,947 | A | | 7/1989 | Kremer et al. | |
| 4,913,175 | A | | 4/1990 | Yokosuka et al. | |
| 4,976,564 | A | | 12/1990 | Fukuoka et al. | |
| 4,984,923 | A | | 1/1991 | Ota | |
| 4,993,859 | A | | 2/1991 | Assad et al. | |
| 5,073,058 | A | * | 12/1991 | Fukuoka et al. | 401/260 |
| 5,123,431 | A | * | 6/1992 | Wilson | 401/119 |
| 5,387,046 | A | * | 2/1995 | Danno | 401/260 |
| 5,568,990 | A | * | 10/1996 | McAuley | 401/206 |
| 5,899,624 | A | | 5/1999 | Thompson | |
| 6,010,263 | A | | 1/2000 | White et al. | |
| 6,513,681 | B2 | | 2/2003 | Gross et al. | |
| 6,634,821 | B2 | | 10/2003 | Gueret | |
| 6,641,320 | B1 | * | 11/2003 | Ballot et al. | 401/206 |
| 6,682,246 | B2 | * | 1/2004 | Reggiani | 401/264 |
| 6,773,193 | B2 | | 8/2004 | Delage | |
| 6,817,801 | B1 | | 11/2004 | Colburn et al. | |
| 6,817,802 | B2 | | 11/2004 | Nishitani et al. | |
| 6,883,995 | B1 | | 4/2005 | Gueret | |
| 6,935,536 | B2 | | 8/2005 | Tardif | |
| 6,945,722 | B2 | | 9/2005 | Colburn et al. | |
| 7,101,105 | B2 | | 9/2006 | Reggiani | |
| 7,114,871 | B2 | | 10/2006 | Thiebaut | |
| 7,563,046 | B2 | | 7/2009 | Patel | |
| 7,658,568 | B1 | * | 2/2010 | Armstrong et al. | 401/206 |
| 2002/0021933 | A1 | | 2/2002 | Knieriemen | |
| 2003/0063942 | A1 | * | 4/2003 | Gardner et al. | 401/16 |
| 2005/0141951 | A1 | | 6/2005 | Gueret | |
| 2006/0083577 | A1 | | 4/2006 | Gueret | |
| 2009/0103968 | A1 | | 4/2009 | Ballot | |

* cited by examiner

LIQUID APPLICATOR DEVICE

CROSS-REFERENCE TO RELATED APPLICATIONS

This application claims benefit of U.S. Patent Provisional application Ser. No. 61/343,981 filed 6 May 2010. All subject matter set forth in provisional application No. 61/343,981 is hereby incorporated by reference into the present application as if fully set forth herein.

BACKGROUND OF THE INVENTION

1. Field of the Invention

This invention relates to the dispensing of liquids and more particularly, this invention relates to an improved liquid applicator device for marking, writing or dispensing a liquid on a surface.

2. Description of the Related Art

Various types of liquid applicator devices have been devised for dispensing a liquid. Some of these liquid applicator devices were used for dispensing an applicator liquid for writing with ink, dye or paint. Among such devices were fountain pens, ball point pens, felt tip pens as well as other types of liquid applicator devices and the like.

These liquid applicator devices of the prior art have received wide acceptance due in great measure to the convenience of the device. Furthermore, these liquid applicator devices of the prior art had the ability to retain a large quantity of applicator liquid and the ability to supply additional applicator liquid from a liquid container to an applicator tip at the discretion of the user. In addition, the liquid applicator devices were not limited to the dispensing of only writing liquid such as paints, dyes and the like but are capable of dispensing a large variety of applicator liquids including chemicals, perfumes, lubricants and the like.

Continuing efforts have been made in the past to improve the design of the liquid applicator devices. The improvements in the design of the liquid applicator devices have concentrated on the liquid dispensing mechanism and for improving the communication of the liquid from the liquid container to the applicator tip for dispensing the applicator liquid onto a surface. In one example of a liquid applicator device, an applicator liquid flows into a fiber applicator tip only when the liquid applicator device is held upside down and the fiber applicator tip is depressed by a surface to be coated by the applicator liquid. The fiber applicator tip communicates with the valve mechanism wherein the valve mechanism permits the flow of applicator liquid. In another example, the solid applicator tip comprises an integral component of the valve assembly, wherein depression of the applicator tip enables applicator liquid to flow to the applicator tip.

U.S. Pat. No. 1,857,467 to Marsh discloses a fountain marker comprising a main reservoir adapted to contain fluid with an end wall for the reservoir having an opening. An auxiliary reservoir is arranged to receive fluid through the opening with a valve opening and closing the discharge outlet. A stem connected to the valve extends through the opening. The fluid is admitted from the main reservoir to the auxiliary reservoir when the valve is closed and is prevented from flowing from the main reservoir to the auxiliary reservoir when the valve is in an open position. A spring holds the valve closed with an applicator tip attached to the valve.

U.S. Pat. No. 2,024,413 to Witt discloses a fountain brush comprising an elongated hollow handle forming a liquid reservoir. A cap is secured to the forward end of the handle having an elongated frusto-conical valve seat and a closure cap on the opposite end of the handle. An elongated conical valve is received in the valve seat. An inwardly projecting stem is formed on the rear end of the valve. The forward end of the valve carries an outwardly projecting shank. A cross-head on the stem having an end is slidably engaged with the inner face of the hollow handle. A contractile coil spring is disposed about the stem having one end anchored to the stem and the other end being anchored in place between the forward cap and handle. A brush-head on the shank and a conical deflector formed on the brush-head are arranged in facing relation to the valve for receiving liquid.

U.S. Pat. No. 2,029,835 to Reichle discloses an applicator for applying liquids to the skin, hair or the like, and has for its object the provision of an improved form of applicator made of a non-absorbent material such as glass, porcelain, synthetic plastic or the like.

U.S. Pat. No. 2,210,662 to Garvey discloses a writing instrument comprising a reservoir for the writing fluid and a valve tiltable in different directions to control the discharge of fluid from the reservoir. A tiltable tip holder is united with and extends from the tiltable valve with the tiltable tip holder having an internal screw thread. A writing tip is made of a yieldable absorbent material and is screwed into the internal thread to project from the lower end of the tip holder. The writing tip is adjustable longitudinally on the screw thread in response to rotary movements of the tip independently of the tip holder. A means limits the rotary movements of the tip holder and includes a tiltable abutment carried by and tiltable with the united valve and tip holder and a fixed abutment co-operating with the tiltable abutment.

U.S. Pat. No. 2,330,053 to Herb discloses a fountain applicator comprising a fluid containing reservoir and a marking nib and means operable by pressure on the nib in excess of that required for marking therewith for forcing fluid from the reservoir to the nib.

U.S. Pat. No. 2,612,162 to Barry discloses a scarifying applicator comprising a container and an apertured cap therefore. A sleeve extends through the cap and having a radially extending flange to be clamped against the container by the cap, the sleeve having an annular spring, seat at its inner end and an inwardly tapered outer end, a headed plunger in the sleeve. The head of the plunger seats against the tapered end of the sleeve. The inner end of the plunger has a slot. A compression spring on the seat has one end received in the slot. The plunger has a generally cylindrical body normally closing the outer end of the sleeve. A reduced portion intermediate its ends has clearance with the outer end of the sleeve upon motion of the plunger inwardly of the sleeve, and scarifying teeth on the outer end of the plunger U.S. Pat. No. 2,714,475 to Roehrich discloses a dispensing type of container of improved, simplified design which is substantially leak-proof and which can be readily and conveniently used for dispensing fluids, including viscous types of fluids such as hand lotion.

U.S. Pat. No. 3,378,330 to Schwartzman discloses an applicator comprising a fluid container having a neck. A retaining ring is fitted in the neck. The retaining ring includes an arcuate inwardly turned re-entrant resilient free edge forming a valve seat. A stepped valve member is provided and is movable with respect to the valve seat to control fluid flow through the retaining ring. The re-entrant free edge engages the sides and upper surfaces of the stepped valve member to successively form an initial seal and a secondary seal.

U.S. Pat. No. 3,468,611 to Ward discloses a liquid applicator having a tubular member of flexible side wall construction. A porous applicator nib and valve means control the flow of liquid from the tubular member to the applicator nib.

U.S. Pat. No. 3,484,027 to Micallef discloses a valve closure for dispensing liquids from a container comprising a cap member attached to one end of the container having a centrally located boss member extending towards the interior of the container. An aperture in the boss member and a flange member is spaced from the boss member and adapted to engage the inside of the mouth of the container in sealing relationship. A valve member including a valve stem is mounted for rotation in the boss member. The valve stem has communicating radial and axial openings with an opening in the boss member being adapted to communicate with the radial opening thereby permitting selective opening and closing of the valve closure. A radially resilient extension extends from one end of the valve stem. The extension has portions which are radially compressible to permit assembly of the valve stem member and the boss member. The radially extending portions are adapted to cooperate with the boss member to prevent disassembly of the valve and the boss member, wherein the resilient extension has a semi-circular shape.

U.S. Pat. No. 3,540,636 to Dvoracek discloses a dispensing valve for liquid soaps or the like comprising a valve body having a downwardly disposed outlet in part defined by a radially outwardly facing frusto-conical valve seat. A valve element of generally inverted cone shape has its base in the valve body and its apex disposed below the outlet in the valve body. The base of the valve element has a downwardly directed skirt or flange. The inner wall of which comprises a seating surface adapted to engage the valve seat at an acute angle. The valve seat flange, or the seating flange or skirt of the body comprises a slightly resilient material, preferably plastic, to provide a wiping seating action of the seating surface against the seat.

U.S. Pat. No. 3,551,065 to Varettoni de Molin, et al. discloses an improved valving construction for felt nib marking devices including a body member forming a chamber at an upper end thereof in direct contact with a supply of inking material. A reciprocating resiliently urged valve is disposed within the chamber, and a bore communicates directly with the lower end of the chamber. A grooved elongated felt nib disposed within said bore projects outwardly thereof at the lower end of the bore. Pressure applied to the lower end of the nib forces the same to project the upper end thereof directly into the chamber against the action of resilient means operating upon the valve. Upon the release of pressure, the valve may exert a pumping action forcing inking material into direct communication with the grooves in the nib to be conducted rapidly to the exposed lower end of the nib.

U.S. Pat. No. 3,680,968 to Schwartzman, et al. discloses a method of correcting a typewritten impression comprising the steps of centering an applicator containing a correction liquid and having a liquid outlet and a valve head extending through the liquid outlet for controlling flow of correction liquid through the liquid outlet in overlying relationship relative to a typed impression with said valve head engaging substantially the center of said typewritten impression. Therefore, said correction liquid is ejected from said applicator to form a disc of correction liquid having a ring of greatest thickness adjacent the periphery of said disc and surrounding the impression to be corrected, and then allowing said disc of correction liquid to dry.

U.S. Pat. No. 4,543,005 to Kuboshima discloses a container for an instantaneous adhesive and more particularly to an arrangement of a so-called pencil-type container which contains the instantaneous adhesive therein. Through use of the present invention, an appropriate small amount of the instantaneous adhesive can be delivered on a part to be bonded through a nozzle disposed at the upper end of the container by urging the top of the container against the part to be bonded. The container is sealed when not in use through a novel spring mechanism which closes the container urging a nozzle against the opening at the tip of the casing.

U.S. Pat. No. 4,685,820 to Kremer et al. discloses an improved applicator device for applying an applicator material such as a liquid or a flowable solid to a surface. The device comprises a material container and a surface applicator for applying the applicator material to the surface. A valve is interposed between the material container and the surface applicator to permit the flow of applicator material to the surface applicator when the valve is in an open position and to inhibit the flow of applicator material to the surface applicator when the valve is in a closed position. The valve includes a valve closure having an internal closure cavity with a first end being connected to the material container and with a second end defining a surface applicator opening therein. The valve element has a distal end portion that extends through the applicator opening of the valve closure when the valve element is biased into the closed position. The surface applicator comprises the distal end portion of the valve element cooperating with the applicator opening when the distal end portion of the valve element is pressed against the surface thereby forming an annular opening for the flow of the applicator material to apply and disperse the applicator material on the surface. U.S. Pat. No. 4,685,820 to Kremer et al. provided a significant step forward in the art of liquid applicator devices.

U.S. Pat. No. 4,792,252 to Kremer et al. discloses a liquid applicator device for applying a liquid such as a paint, a perfume, a chemical, a coating or the like to a surface by writing, marking or painting. The liquid applicator device includes a container for the liquid and an applicator dispensing mechanism. The applicator dispensing mechanism includes an inner subassembly having a valve and an outer subassembly having the surface applicator. The valve regulates the flow of the liquid from the container to the surface applicator. The valve of the applicator device may be opened to allow the liquid to flow from the container to the surface applicator upon depression of the surface applicator or upon depression of a valve actuator. The liquid applicator device incorporates an improved sealing member for sealing with the sides of the surface applicator for reducing the flow of the applicator liquid along the side of the surface applicator. The surface applicator may be in the form of a fiber tip, a brush or similar applicator. The applicator dispensing mechanism may be fabricated independent of the attachment to the container. The valve seal has a flexibly mounted tubular extension which holds the inner end of the surface applicator to maintain the liquid seal during lateral movement of the outer end of the surface applicator.

U.S. Pat. No. 4,848,947 to Kremer, et al. discloses an improved applicator device for applying an applicator liquid such as a chemical, a coating, a solvent or other suitable liquids to a surface. The device comprises a container for containing the applicator liquid and a tilt valve secured to the container. The tilt valve has a valve element normally biased into a closed position. The valve element inhibits the flow of the applicator liquid from the container when the valve element is in the closed position and permits the flow of the applicator liquid from the container when the valve element is tilted into an open position. A surface applicator has a proximal end for receiving the applicator liquid flowing through the tilt valve and has a distal end adapted to apply the applicator liquid to the surface. Means are provided for allowing a user to laterally move the surface applicator for enabling the proximal end of the surface applicator to tilt the valve element into the open position to permit the flow of the applicator liquid from the container to the proximal end to replenish the applicator liquid at the distal end of the surface applicator. The surface applicator may be a flexible applicator such as an applicator brush, a flexible fiber tip or the like which permits a user to disperse or paint the applicator liquid on a surface. The improved applicator device is suitable for dispensing a wide variety of liquid products including inks, dyes, paints, coatings, chemicals, insect repellants, perfumes, solvents and the like.

U.S. Pat. No. 4,935,001 to George discloses a swab for collecting and removing material from small openings. The swab includes an absorbent tip attached to an elongated rod. The absorbent tip has an outer surface with at least one recess in which material is collected.

U.S. Pat. No. 4,976,564 to Fukuoka et al. discloses an implement for applying a liquid comprising a container having an opening at a front end and a front tube attached to the container forward end. A hollow accommodating member has a chamber in an interior and formed with a rearward communication hole and a forward communication hole for holding the chamber in communication with the interior of the container and the interior of the front tube respectively. A liquid feed member is accommodated in the chamber and is movable axially thereof. A biased end valve is disposed inside the front tube to provide a liquid retaining portion inside the front tube around the end valve for closing the forward end opening of the front tube. An applicator having a capillary action extends through the forward end opening of the front tube and is secured to the front end of the end valve.

U.S. Pat. No. 4,984,923 to Ota discloses an operating member inserted in the middle cylinder to be movable backward and forward in the axial direction. A valve mechanism is provided in the front portion of the middle cylinder to supply the pinpoint with the applied liquid stored in the rear portion of the middle cylinder. The valve mechanism includes a valve seat having a valve hole with a valve spindle being provided with a valve element for opening and closing the valve hole and a stretchable member for moving the valve spindle backward and forward. The stretchable member is elongated and shortened in the axial direction of the middle cylinder as the bent portions are bent less and more, respectively. The operating element at the rear end of the middle cylinder is operated to move the operating member forward to push the bent portions of the bent arms to elongate the stretchable member. The valve spindle is moved backward to open the valve hole to supply the applied liquid to the pinpoint.

U.S. Pat. No. 4,993,859 to Assad et al. discloses a liquid applicator including a valve body for insertion into the neck of a liquid container and defining a duct in the valve body. A resilient web is formed integrally with the valve body and extends transversely across the duct. A valve seat is located on one end of the valve body. A valve member is secured to the resilient web and has a valve biased into engagement with the valve seat at the end of the valve body. A coating member is mounted on the opposite end of the valve body. A valve stem on the valve member is located proximate the coating member for being deflected when the coating member is compressed onto an external surface to thereby unseat the valve and permit liquid to flow through the duct onto the coating member.

U.S. Pat. No. 4,913,175 to Yokosuka et al. discloses a liquid-applying tip assembly in which the liquid-applying member is pushed to operate the valve to allow the liquid to flow to the liquid-applying member. The liquid-applying member is a plastic member which comprises: a plurality of ribs extending radially and axially from an axial core in such a manner as to form a plurality of axial liquid passageways therebetween. A barrier is provided between the valve and the cylinder of the tip assembly, the barrier having a hole whose diameter is slightly larger than the outside diameter of the liquid-applying member to control the flow of liquid.

U.S. Pat. No. 5,073,058 to Fukuoka, et al. discloses an implement for applying a liquid including a container for holding liquid. The container has a front end which is open and a front tube mounted on the front end of the container. The front tube has a forward outlet opening. A hollow accommodating member has an interior chamber, the accommodating member has a rear opening communicating the interior chamber with the container and a forward opening communicating the interior chamber with the front tube. A liquid feed member is movably disposed in the interior chamber between a closed position in which the liquid feed member engages the forward opening to block off communication between the interior chamber and the front tube and an open position in which the liquid feed member is disengaged from the forward opening. An end valve is axially movable in the front tube between a closed position and an open position and an open position. An applicator is mounted on the end valve. The liquid feed member is constructed such that when the implement is axially shaken, the liquid feed member temporarily moves from its closed position to its open position to pass liquid from the interior chamber of the accommodating member to the applicator.

U.S. Pat. No. 5,123,431 to Wilson discloses a cosmetic applicator tip having a plurality of dimples on an exterior surface thereof for receiving and dispensing a cosmetic. The tip is injection molded from a soft material to provide the tip with a pleasing "feel" when rubbed against the skin of a user. An air cushion within the tip can be varied to adjust or regulate the "feel" of the tip.

U.S. Pat. No. 5,388,700 to Per-Lee discloses a device for applying skin treatment substances to the back of a person including a manually grippable elongated shaft having a head formed thereon, and a plurality of contact pads, each selectively engageable with and disengageable from the head without damaging the head or pads. A first contact pad has a non-porous contact surface for applying relatively viscous substances to the skin of the person, a second contact pad has a porous contact surface for retaining relatively non-viscous substances for applying the relatively non-viscous substances to the skin of the person, and a third contact pad has a sisal contact surface for cleansing the skin of the person. Also, a fourth contact pad has an erose surface for gently scratching the person's back when rubbed against it. A bag is provided for holding the shaft and contact pads.

U.S. Pat. No. 5,568,990 to McAuley discloses a liquid applicator providing for a self-sealing feature, which applicator comprises a housing, a valve member and a spring member. The housing has an aperture through its top wall and an annular sleeve projecting inwardly from an edge of the top wall in a surrounding relation with the aperture, the annular sleeve having an end portion. The valve member includes an actuating part that is slideably received by the annular sleeve and a sealing part that is shaped to form a releasable seal with the end portion of the annular sleeve. The valve and spring members are disposed in an axially displaceable relation such that the actuating part of the valve member is resiliently urged into the annular sleeve; that a part of the actuating part protrudes from the top wall of the housing; and that the sealing part of the valve member sealably engages with the end portion of the annular sleeve.

U.S. Pat. No. 5,851,079 to Horstman, et al. discloses a unidirectional twist-up dispensing device with incremental dosing for dispensing a product. This twist-up dispensing device includes a hollow housing defining a chamber having an open dispensing end and an open actuating end having a interior surface. A piston located within the chamber being limited to translational movement within the chamber. The piston having a top side facing the dispensing end of the housing forming a variable volume portion of the chamber for storing the product. The piston also has a threaded rod extending therefrom opposite the top side. An actuator having a threaded aperture therethrough that engages the interior surface at the actuating end of the housing is also provided. The threaded aperture is concentric in the actuator and the actuator is adapted to rotate with respect to the housing in only one direction. The threaded rod engages the threaded aperture such that advancement of the piston toward the dispensing end occurs when the actuator is rotated, thereby causing the product to be dispensed. An applicator can be attached to the dispensing end of the housing in fluid communication with the variable volume portion of the chamber wherein the product is dispensed through the applicator. The applicator comprises a ferrule and an application portion. The ferrule is attached to the dispensing end of the housing and the application portion has at least one orifice located therein. Several versions of the applicator are illustrated, including a fiber brush and a flocked application surface.

U.S. Pat. No. 5,888,005 to Gueret discloses a capillary dosing unit including a stem with an axis of symmetry, a grip at a first end of the stem and at least one slit at a second end of the stem which emerges along the axis of the stem. This dosing unit allows accurate dosing of a liquid such as a nailcare oil.

U.S. Pat. No. 6,315,482 to Girardot, et al. discloses an applicator for applying and distributing a substance onto a target surface. The applicator comprises a substantially planar sheet of compressible, conformable material having opposed first and second surfaces and an interior region between said first and second surfaces. The sheet of material has a thickness between the first and second surfaces which decreases when the sheet of material is subjected to an externally-applied force in a direction substantially normal to the first surface. The applicator further includes at least one discrete reservoir extending inwardly of the first surface into the interior of the sheet of material which is at least partially filled with a substance and at least one discrete aperture formed in the first surface which is in fluid communication with the reservoir. Compression of the sheet of material via an externally-applied force substantially normal to said first surface expresses product from the aperture and translational motion of the first surface relative to a target surface applies and distributes said product onto the target surface. In a preferred embodiment, a plurality of apertures are associated with corresponding reservoirs forming a delivery zone near one end of a hand-held applicator, and the sheet material is preferably resilient both in compression and in bending to conform to irregular target surfaces. A wide variety of substances are contemplated, including particularly antiperspirant/deodorant products. Other embodiments include a single reservoir feeding a plurality of apertures.

U.S. Pat. No. 6,322,271 to Girardot, et al. discloses an applicator for applying and distributing a substance onto a target surface. The applicator comprises a substantially planar sheet of conformable material having opposed first and second surfaces and an interior region between said first and second surfaces. The sheet of material has a thickness between the first and second surfaces. The applicator further includes at least one discrete reservoir underneath the first surface which is at least partially filled with a substance and at least one discrete aperture formed in the first surface which is in fluid communication with the reservoir. Compression of the applicator via an externally-applied force substantially normal to said first surface expresses product from the aperture and translational motion of the first surface relative to a target surface applies and distributes said product onto the target surface. A removable cover sheet which aids in the containment of the substance and also contributes to a pre-removal stiffness value for the applicator such that the pre-removal stiffness value is at least three times greater than a post-removal stiffness value for the applicator. The stiffness of the removable cover sheet can also provide protection against bending that could lead to failure of the containment, against puncture, and against other damage to the product rheology, homogeneity, etc. A wide variety of substances are contemplated, including particularly antiperspirant/deodorant products.

U.S. Pat. No. 6,513,681 to Gross et al. discloses a spray dispensing closure including a spray plug and a cap cooperating therewith to selectively occlude passages in the spray plug. A spray plug includes a set of inner passages for conveying product from a dip tube through the spray plug and a set of outer passages for conveying air from a head space in the container. The inner passages communicate with an inner flow space and the outer passages communicate with an outer flow space. A cap cooperates with the spray plug to define an outer chamber and an inner chamber which are isolated from one another when the cap is in the closed position, thereby preventing the mixing of air and product. As the cap is moved to the open position, the cap chambers are permitted to communicate with one another and, as the container is squeezed, a product/air mixture is formed in the closure. A central spray plug post has an upper portion that forms at least one restrictive passage with an inner wall of the cap when the cap is in the open position. As the air/product mixture flows through the restrictive passages, a spray mist is formed and dispensed through at least one dispensing orifice formed in the cap and communicating with the restrictive passages. In an alternative embodiment, only a single set of inner passages are provided on the spray plug and communicate with the head space in the container. A series of dip tube exit passages extend from a proximal end of the dip tube. A plurality of dip tube end engaging ribs extend from the spray plug. When the container is squeezed and the cap is open, product is conveyed from the dip tube and into the inner passages to be mixed with air from the head space.

U.S. Pat. No. 6,634,821 to Gueret discloses a device and system for applying a product, for example, a cosmetic product. The device includes a first compartment containing the product, and a second compartment in flow communication with the first compartment via at least one supply orifice, with the second compartment having an opening which may be removably closed by a closure element. The second compartment may form a housing for an applicator which is insoluble with respect to the product. The applicator may rest against an elastically compressible porous member that may be in flow communication with the supply orifice.

U.S. Pat. No. 6,684,887 to Alexander discloses a hair separator and fluid applicator that includes a central handle portion, a parting portion disposed adjacent the central handle portion, and an applying portion disposed adjacent the central handle portion opposite the parting portion. The parting portion includes a proximal end and a distal end, the distal end being disposed opposite the central handle portion and generally narrowing from the proximal end to the distal end. The parting portion also may include a generally concave face. The applying portion includes a blade. The blade includes dimples or holes designed to increase the ability of less-viscous fluids or creams to remain adhered to the surface of the blade. The applying portion may also include teeth disposed along a distal portion for assisting in the application and directional smoothing of the hair during use. The channels between the teeth may vary in, shape, including (for example) being half-circular, ovular or rectangular in shape.

U.S. Pat. No. 6,773,193 to Delage discloses a device for packaging and applying a substance, in particular a cosmetic or a care product, the device comprising a receptacle for containing the substance. The receptacle is provided at the top with an applicator that is permeable to the substance and that has an inside face fed with the substance coming from the receptacle. In the vicinity of the bottom face of the applicator, the device comprises an element that forms an intermediate reservoir that is in permanent communication with the receptacle and that is suitable for retaining a certain quantity of the substance when the device is turned upside-down from a head-up position and is then returned to the head-up position. The intermediate reservoir-forming element are arranged to enable the substance retained in this way to feed the applicator, at least in certain conditions of use of the device.

U.S. Pat. No. 6,817,801 to Colburn et al. discloses an applicator device for applying treatment fluid to various interior surfaces such as those found in an automobile, which is constructed with an applicator head including a housing having a bottom distribution plate and an applicator pad affixed thereto, and which is configured to complementally and releasably receive an associated fluid container.

U.S. Pat. No. 6,817,802 to Nishitani et al. discloses a writing instrument adapted, responsive to a pressure axially applied to a pen core, to supply ink in an ink chamber to the pen core. The writing instrument includes a valve seat disposed between the ink chamber and the pen core. A valve body is operable to be selectively moved between a close position where the valve body is in contact with the valve seat to isolate the pen core from the ink chamber and an open position where the valve body is spaced apart from the valve seat to communicate the pen core with the ink chamber. A pressing spring biases the valve body toward the front end of a pen shaft, and a support member for supporting the valve body and the pressing spring to allow the valve body to be moved in the axial direction. The support member includes a communication channel for communicating the inner space thereof with the ink chamber. The valve body has a channel control portion for allowing the ink flow through the communication channel to be more restricted when the valve body is in the close position that when it is in the open position. The writing instrument can reduce the deposit of ink pigments around the valve body to prevent occurrence of defect in the operation of the valve body.

U.S. Pat. No. 6,945,722 to Colburn et al. discloses a tire applicator for applying treatment fluid to sidewall of a vehicle tire, which is constructed with an applicator head including a dispenser housing having a bottom distribution plate and an applicator pad affixed thereto, and which may be configured to complementally and releasably receive an associated container.

U.S. Pat. No. 7,101,105 to Reggiani discloses a container-applicator for fluid products for cosmetic and pharmaceutical use. An applicator is provided with a spongy-matrix body that is arranged proximate to an opening controlled by a valve element that can be operated from the outside of the container body, the valve element comprising a cap body that can be actuated rotationally in order to pass from a closed position to an open position of the opening and/or vice versa.

U.S. Pat. No. 7,114,871 to Thiebaut discloses a packaging and application device for a product, specifically a cosmetic product. The device includes a receptacle for cleaning the product having a longitudinal axis and a passageway. The receptacle also includes a porous or fibrous applicator element capable of communicating with the product in the receptacle through the passageway. A dispensing element adapted for opening and closing the passageway. The device further contains a dispensing element adapted for opening and closing the passageway and includes a mobile part rotatable about the longitudinal axis between a first position in which the passage is closed and a second position in which the passage is open. The device also includes a closure cap capable of engaging a dispensing element.

In my prior U.S. Pat. No. 6,641,320, I disclosed an improvement to U.S. Pat. No. 4,685,820 to Kremer et al. comprising an applicator tip having a recess and a generally toroidal retaining ring disposed in the recess of the applicator tip. The recess cooperates with the retaining ring for preventing removal of the applicator tip from the liquid applicator device.

U.S. Patent Application 2008/0170904 to Bayly, et al. discloses an implement for applying a volume of liquid to a treatment surface. The implement includes a support means onto which is mounted a receptacle. The receptacle defines a reservoir space which receives the liquid. The receptacle includes a wall having a working surface that is used to spread the liquid over the treatment surface. The wall is resiliently deformable so in use the working surface maintains contact with the treatment surface when spreading the liquid. The implement has a specific application in applying a transdermal lotion to the axilla area of the user. The invention also relates to a system for transdermal administration of a physiological active agent from a liquid composition and a method of conducting the same.

There have been many in the prior art who have attempted to solve the problems associated with liquid applicator devices with varying degrees of success. None, however completely satisfies the requirements for a complete solution to the aforestated problem.

Therefore, it is an object of the present invention is to provide an improved liquid applicator device that is simpler in design and more economical to manufacturer than prior art devices.

Another object of the present invention is to provide an improved liquid applicator device that has a reduced number of parts.

Another object of the present invention is to provide an improved liquid applicator device that that requires a reduced number of stages for assembly.

Another object of the present invention is to provide an improved liquid applicator device that may be used with existing containers.

Another object of the present invention is to provide an improved liquid applicator device that may be used with liquids previously unusable in the liquid applicator devices of the prior art.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

A specific embodiment of the present invention is shown in the attached drawings. For the purpose of summarizing the invention, the invention relates to an improved liquid applicator device for applying a liquid from a container to a surface. The liquid applicator device comprises a closure defining a closure aperture secured to the container. A sealing member sealingly engages with the closure mounting. The sealing member has a tubular sleeve. An applicator is slidably disposed within the tubular sleeve. The applicator comprises a hollow interior with an applicator tip defined by an outer applicator portion of the applicator. A biasing member urges the applicator to form a seal with the sealing member. A depression of the outer applicator portion against the surface displaces the applicator from the sealing member to enable the flow of the liquid from the container to the applicator tip of the applicator.

In a more specific embodiment of the invention, the applicator is generally a hollow shell. The flow of the liquid from the container flows between the tubular sleeve and the outer applicator portion of the applicator. The outer applicator portion of the applicator defines a generally hemispherical distal end. In one example, the generally hemispherical distal end has a plurality of dimples.

In another embodiment of the invention, the liquid applicator device comprises a closure having closure mounting for securing the closure to the container. The closure defines a closure aperture extending therethrough. A sealing member comprises a sealing surface. The sealing member has a sealing member mounting for sealingly engaging with the closure. The sealing member has a tubular sleeve. An applicator includes an inner applicator portion, an intermediate applicator portion and an outer applicator portion. The outer applicator portion of the applicator defines an applicator tip. The applicator is slidably disposed within the tubular sleeve for movement between an extended position and a retracted position. A biasing member coacts between the closure and the applicator for urging the applicator into the extended position for forming a seal between the sealing surface and the applicator. A depression of the outer applicator portion against the surface displaces the applicator from the extended position to the retracted position to displace the applicator from the sealing surface to enable the flow of the liquid from the container to the applicator tip of the outer applicator portion of the applicator.

In a more specific embodiment of the invention, the biasing member comprises a spring coacting between a spring step located within the closure and the inner applicator portion of the applicator for biasing the applicator into sealing engagement with the sealing surface of the sealing member for inhibiting the flow of the liquid from the container. A biasing base extends from the closure into the closure aperture defining a spring retaining step. The outer applicator portion of the applicator and the tubular sleeve defines a passageway therebeween for enabling the flow of liquid therethrough. A projection extends from the sealing member with a distal end thereof defining the sealing surface.

The inner applicator portion of the applicator defines an inner applicator diameter. The outer applicator portion of the applicator defines an outer applicator diameter. The inner applicator diameter is greater than the outer applicator diameter. An angularly disposed intermediate portion is interposed between the inner applicator diameter and the outer applicator diameter. The angularly disposed intermediate portion engages with the sealing surface for inhibiting the flow of the liquid from the container to the outer applicator portion when the applicator is urged into the extended position.

In another embodiment, the invention is incorporated into a liquid applicator device for applying a liquid from a container to a surface comprising a closure secured to the container.

An applicator is slidably disposed within the closure. The applicator comprises a hollow interior with an applicator tip defined by an outer applicator portion of the applicator. A biasing member urges the applicator against a seal surface within the closure for inhibiting liquid flow to the applicator tip. A depression of the outer applicator portion against the surface displaces the applicator from the sealing surface to enable the flow of the liquid from the container to the applicator tip of the applicator.

In still a further another embodiment, the invention is incorporated into a liquid applicator device for applying a liquid from a container to a surface comprising a closure threadably secured to the container. An applicator having an applicator tip slidably is disposed within the closure. A biasing member urges the applicator against a seal surface within the closure for inhibiting liquid flow to the applicator tip. A depression of the outer applicator portion against the surface displaces the applicator from the sealing surface to enable the flow of the liquid from the container to the applicator tip of the applicator. An alternate applicator is secured to the closure and located within the container.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
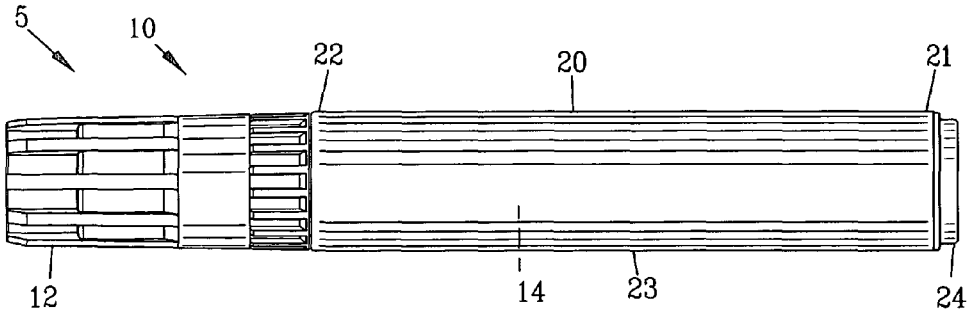
FIG. 1 is a side view of a first embodiment of a liquid applicator device of the present invention with a protective cap covering an applicator tip.

FIG. 1 is a side view of a liquid applicator device 5 of the present invention with an applicator mechanism 10 covered by a protective cap 12. The liquid applicator device 5 is designed to dispense a liquid 14 onto a surface 16 shown in FIGS. 11-14 from a container 20.

Figure 2:
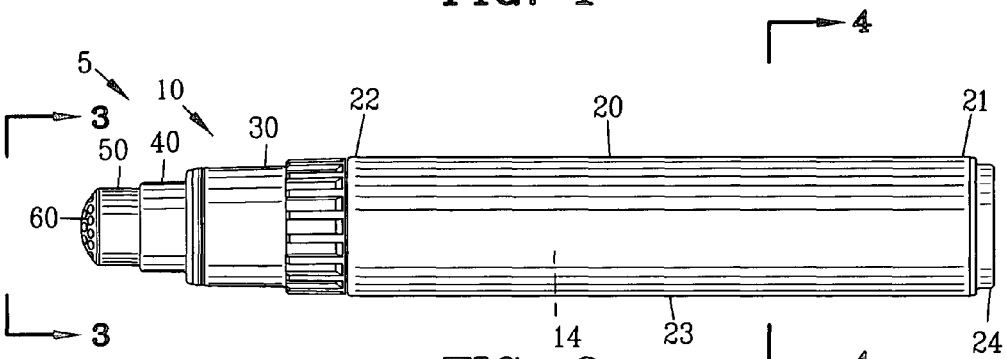
FIG. 2 is a side view similar to FIG. 1 with the protective cap removed from the liquid applicator device.

FIG. 2 is a side view similar to FIG. 1 with the protective cap 12 removed from the liquid applicator device 5. The liquid applicator device 5 is connected to a container 20 for retaining the liquid 14.

Figure 3:
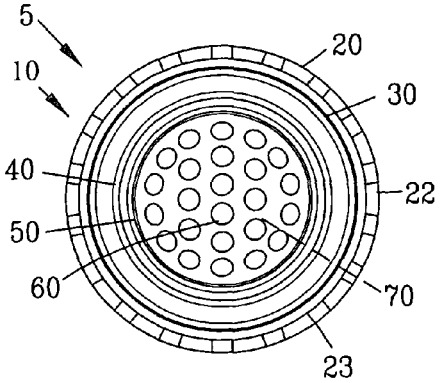
FIG. 3 is an enlarged sectional view along line 3-3 in FIG. 2.
Figure 4:
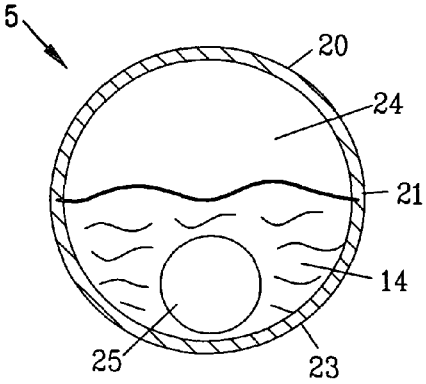
FIG. 4 is an enlarged sectional view along line 4-4 in FIG. 2.

FIGS. 3 and 4 are enlarged sectional views in FIG. 2. In this example, the container 20 is shown having a cylindrical shape extending between a first end 21 and a second end 22 and a sidewall 23. A plug 24 is inserted to close the first end 21. The plug 24 enables the liquid 14 to be introduced into the first end 21 of the container 20 when the applicator mechanism 10 is secured to the second end 22 of the container 20.

It should be appreciated by those skilled in the art that the container 20 may be formed in various shapes and made from various types of materials and the present invention should not be limited to any specific shape or specific material type of the container 20.

The applicator mechanism 10 comprises a closure 30, a sealing member 40 and an applicator 50 defining an applicator tip 60. A biasing device 70 shown as a coil spring urges the applicator 50 into an extended position as shown in FIG. 2.

Figure 5:
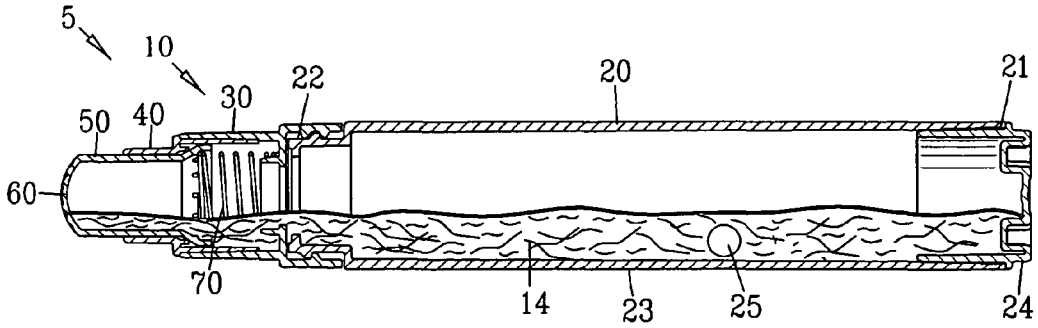
FIG. 5 is a side sectional view of the liquid applicator device of FIG. 2.

FIG. 5 is a side sectional view of the liquid applicator device 5 of FIG. 2 illustrating the liquid 14 within the liquid applicator device 5. The liquid 14 is free to flow by action of gravity from the container 20 into the applicator mechanism 10.

Figure 6:
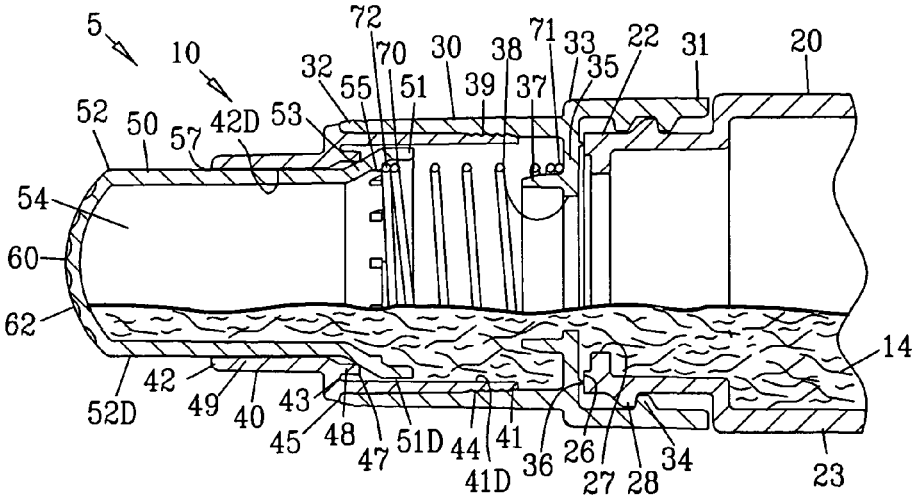
FIG. 6 is an enlarged view of a portion of FIG. 5.

FIG. 6 is an enlarged view of a portion of FIG. 5. The second end 22 of the container 20 is provided with an annular rim 26 defining an opening 27. In this example, the second end 22 of the container 20 is provided with integral container threads 28 for securing the applicator mechanism 10 to the second end 22 of the container 20. The liquid 14 is free to flow by action of gravity from the container 20 into the applicator 50.

Figure 7:
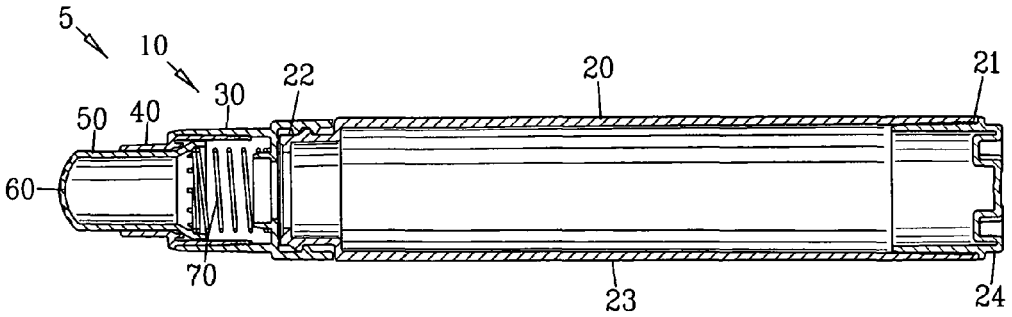
FIG. 7 is a view similar to FIG. 5 with the liquid removed from the liquid applicator device and with the applicator tip located in an extending position.
Figure 8:
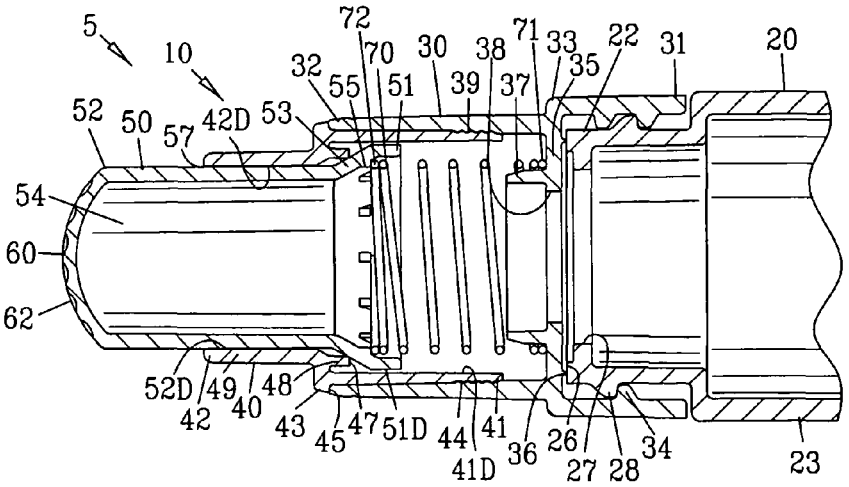
FIG. 8 is an enlarged view of a portion of FIG. 7.

FIGS. 7 and 8 are views similar to FIGS. 5 and 6 with the liquid 14 removed from the liquid applicator device 5. The closure 30 extends between a first end 31 and a second end 32 and intermediate portion 33 disposed there between. The first end 31 of the closure 30 includes a closure mounting 34 shown as integral threads for engaging with the container threads 28 for securing the first and 31 of the closure 30 to the second end 22 of the container 20. The closure 30 includes a transverse wall 35 having a sealing ring 36. A tightening of the closure threads 34 with the container threads 28 provides a compression seal between the sealing ring 36 of the closure 30 and the annular rim 26 of the container 20. In the alternative, the container 20 may be secured to the closure 30 of the applicator mechanism 10 by various other means such as a press fit the engagement and the like as should be well known to those skilled in the art.

The transverse wall 35 includes a biasing base 37 for providing a support for a first end 71 of the biasing members 70. The transverse wall 35 defines a closure aperture 38 for providing a fluid path for the liquid 14 from the container 20 to the applicator 50. The second end 32 of the closure 30 is tapered toward the distal end thereof and includes a serrated region 39.

A sealing member 40 comprising a first or an inner sealing member portion 41 and a second or outer sealing member portion 42 with an intermediate sealing member portion 43 disposed between the inner sealing member portion 41 and the outer sealing member portion 42.

The inner sealing member portion 41 defines an inner sealing member diameter 41D whereas the outer sealing member portion 42 defines an outer sealing member diameter 42D. The inner sealing member diameter 41D is larger than the outer sealing member diameter 42D.

The inner sealing member portion 41 includes a serrated region 44 for engaging with the serrated region 39 of the closure 30 to seal the sealing member 40 to the closure 30. The tapered second end 32 of the closure 30 facilitates insertion of the inner sealing member portion 41 into the second end 32 of the closure 30. A stop 45 extends outwardly from the inner sealing member portion 41 for engaging with the second end 32 of the closure 30 to limit the depth of insertion of the sealing member 40 into the closure 30.

The intermediate sealing member portion 43 extends between the inner sealing member diameter 41D and the outer sealing member diameter 42D.

A sealing surface 47 is defined by the intermediate sealing member portion 43 of the sealing member 40. In this embodiment, an annular projection 48 extends axially toward the inner sealing member portion 41 coaxial with the inner sealing member diameter 41D. The distal end of the annular projection 48 defines the sealing surface 47. The annular projection 48 extends axially away from the applicator tip 60.

The outer sealing member portion 42 of the sealing member 40 is a tubular sleeve defining the outer sealing member diameter 42D. The inner sealing member diameter 41D is larger than the outer sealing member diameter 42D.

The applicator 50 has a first or an inner applicator portion 51 and a second or outer applicator portion 52 with an intermediate applicator portion 53 located therebetween. The inner applicator portion 51 of the applicator 50 defines an inner applicator diameter 51D whereas the outer applicator portion 52 of the applicator 50 defines an outer applicator diameter 52D. The intermediate portion 53 is angularly interposed between the inner applicator diameter 51D and the outer applicator diameter 52D to form an angularly disposed intermediate portion 53 for sealing engaging with the sealing surface 47.

A biasing retainer 55 is located within the interior 54 of the applicator 50. The biasing retainer 55 provides a support for the biasing members 70. More specifically, the biasing retainer 55 provides a set for receiving a second end 72 of the biasing members 70.

The applicator 50 is generally hollow shell defining hollow interior 54. A distal end of the outer applicator portion 52 of the applicator 50 forms the applicator tip 60. The applicator tip 60 is a generally partially hemispherical tip 60. Preferably, the generally partially hemispherical tip 60 includes a plurality of dimples 62 uniformly distributed about the hemispherical portion of the tip 60.

The applicator 50 is slidably disposed within the sealing member 40 with the inner applicator portion 51, the intermediate applicator portion 53 and the outer applicator portion 52 being located adjacent to the inner sealing member portion 41, the intermediate sealing member portion 43 and the outer sealing member portion 42, respectively. The applicator 50 is slidably moveable between an extended position as shown in FIGS. 5-8 and a retracted position as shown in FIGS. 9-10.

The outer applicator portion 52 of the applicator 50 and the tubular sleeve of the outer sealing member portion 42 defines a passageway 57 therebetween for enabling the flow of liquid therethrough. The diameter 42D of the tubular sleeve of the outer sealing member portion 42 and the diameter 52D of the outer applicator portion 52 of the applicator 50 are selected to provide the optimum passageway 57 for the viscosity of the liquid 14.

The biasing member 70 coacts between the closure 30 and the applicator 50 for urging the applicator 50 into the extended position as shown in FIGS. 5-8 to form a seal with the sealing member 40. The biasing member 70 is positioned between the biasing base 37 of the transverse wall 35 of the closure 30 and the biasing retainer 55 within the interior 54 of the applicator 50. The seal is formed by the biased engagement of the angularly disposed intermediate portion 53 of the applicator 50 against the sealing surface 47 located in the distal end of the annular projection 48. The seal formed between the angularly disposed intermediate portion 53 and the sealing surface 47 inhibits the flow of the liquid 14 from the container 20 to the outer applicator portion 52 of the applicator 50.

Figure 9:
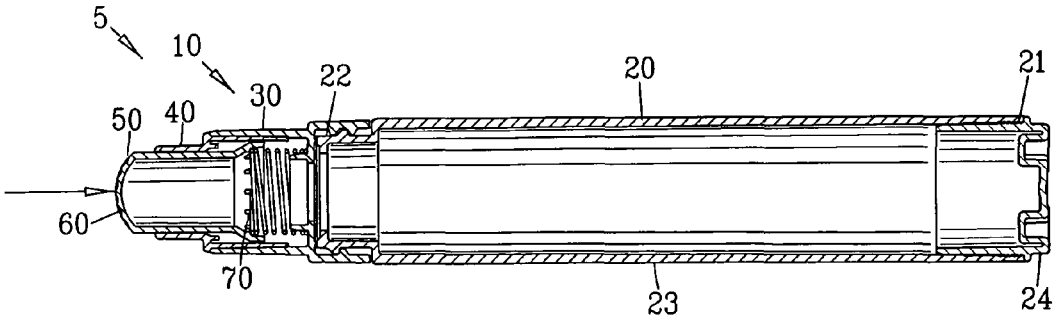
FIG. 9 is a view similar to FIG. 7 with the applicator tip displaced into a retracted position.
Figure 10:
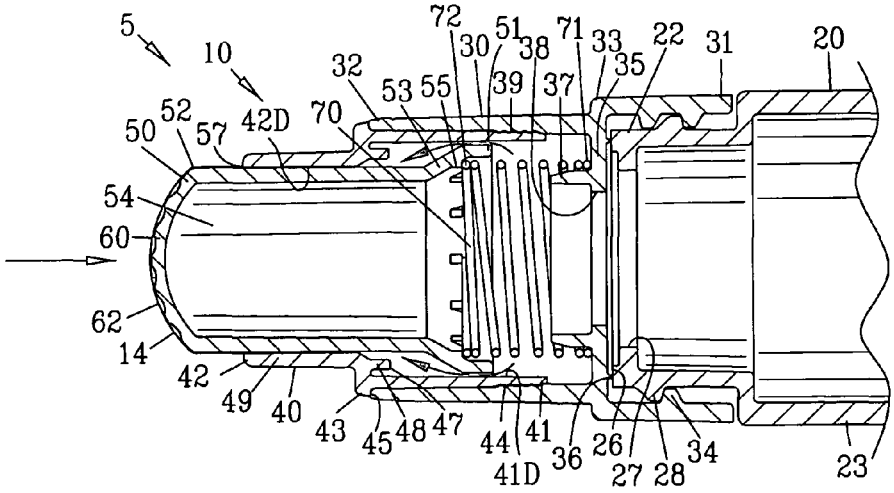
FIG. 10 is an enlarged view of a portion of FIG. 9.

FIGS. 9 and 10 are views similar to FIGS. 7 and 8 with the applicator 50 displaced into the retracted position. The movement of the applicator 50 into the retracted position displaces the angularly disposed intermediate portion 53 of the applicator 50 from engaging with the sealing surface 47 located in the distal end of the annular projection 48 to permit the flow of the liquid 14 from the container 20 to the outer applicator portion 52 of the applicator 50.

Figure 11:
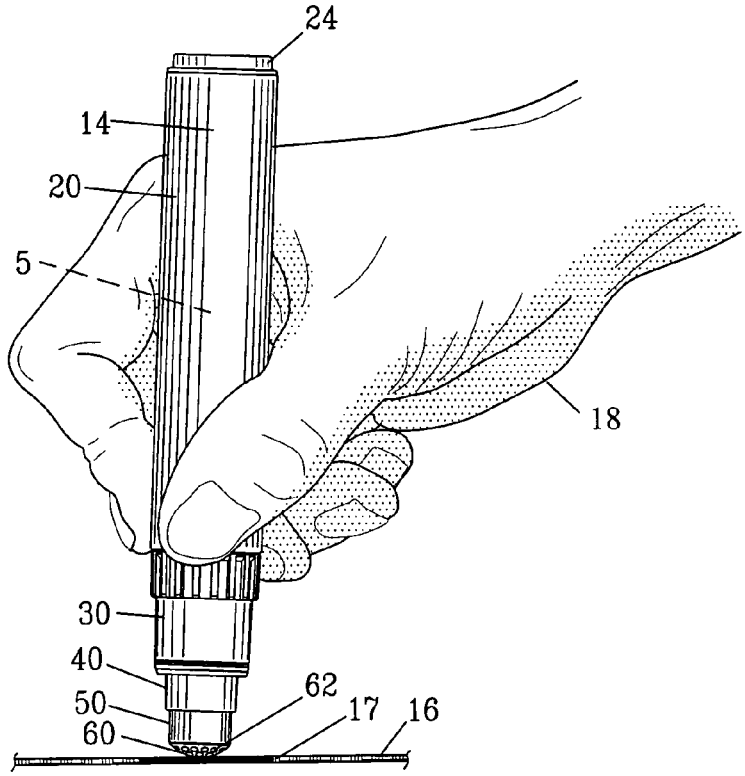
FIG. 11 is a view of the liquid applicator device positioned over a surface by an operator.

FIG. 11 is a view of the liquid applicator device 5 positioned over a surface 16 by an operator 18. The liquid 14 is free to flow through the closure aperture 38 into the interior of the sealing member 40. The biasing member 70 urges the applicator 50 into the extended position as shown in FIG. 11 to form a seal with the sealing member 40 and inhibit the flow of liquid 14 to the applicator tip 60 as described previously. In this example, the liquid applicator device 5 is illustrated as dispensing a cleaning agent to a fabric surface 16 having pores 17.

Figure 12:
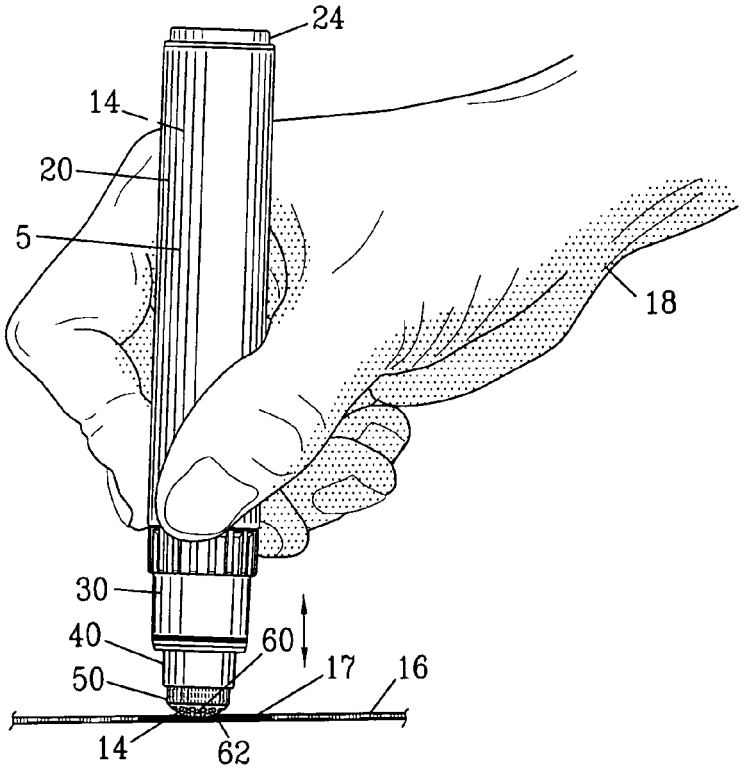
FIG. 12 is a view of the liquid applicator device impressed against the surface for dispensing the liquid.

FIG. 12 is a view of the liquid applicator device 5 impressed against the fabric surface 16 by the operator 18. A depression of the applicator tip 60 against the fabric surface 16 displaces the applicator 50 from the sealing member 40 to enable the flow of the cleaning liquid 14 from the container 20 to the applicator tip 60 of the applicator 50.

The cleaning liquid 14 flows by action of gravity from the container 20 around the sealing surface 47 to enter the passageway 57 between the outer applicator portion 52 of the applicator 50 and the tubular sleeve of the outer sealing member portion 42. The cleaning liquid 14 continues to flow by gravity and/or capillary action through the passageway 57 to the applicator tip 60.

Figure 13:
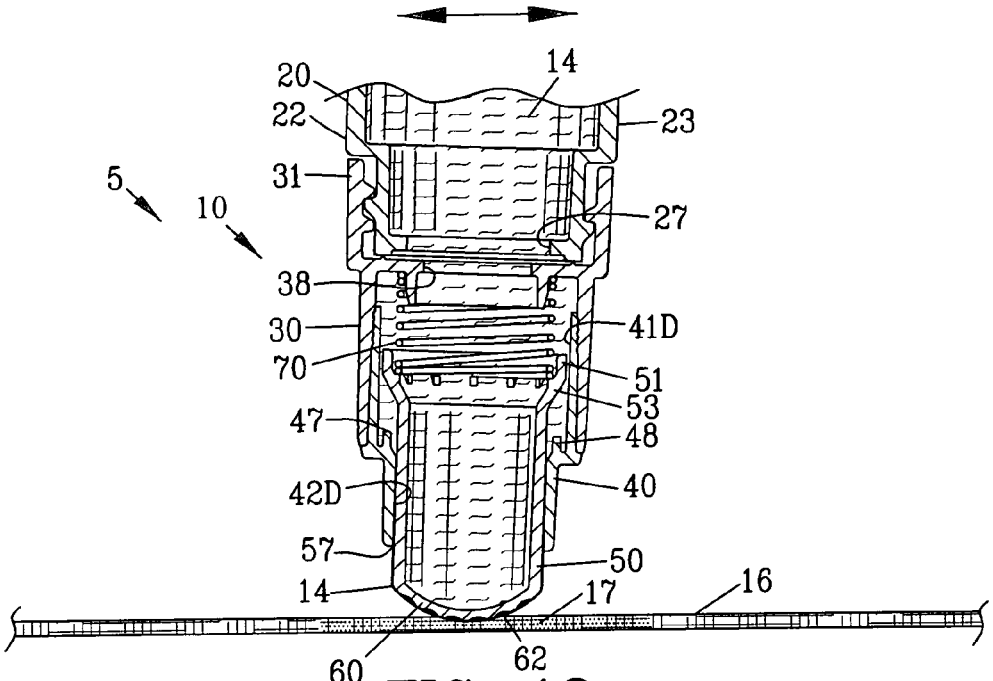
FIG. 13 is an enlarged view of a portion of FIG. 12 illustrating the movement of the liquid applicator device for dispensing of the liquid into the surface.

FIG. 13 is an enlarged view of a portion of FIG. 12 illustrating the movement of the liquid applicator device 5 for dispensing of the cleaning liquid 14 into the fabric surface 16. The cleaning liquid 14 moves by gravity and/or capillary action to fill the plurality of dimples 62 located on the generally partially hemispherical tip 60. The plurality of dimples 62 function as reservoirs to retain the cleaning liquid 14 and then dispense larger quantities of the cleaning liquid 14 on to the fabric surface 16.

Figure 14:
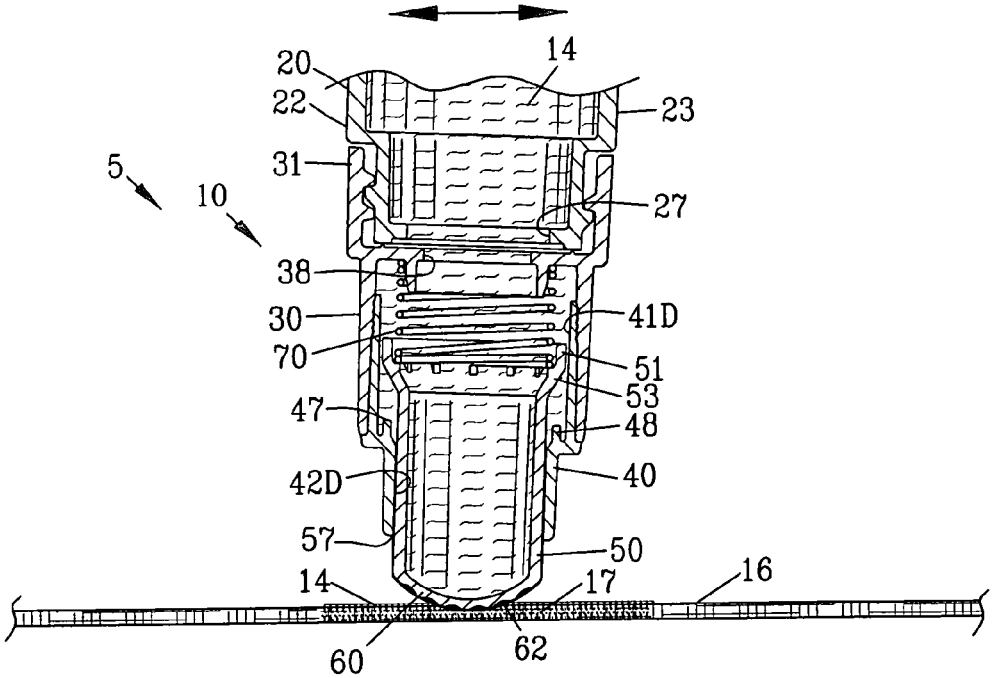
FIG. 14 is a view similar to FIG. 13 illustrates a continued movement of the liquid applicator device for working the liquid into the surface.

FIG. 14 illustrates a continued movement of the liquid applicator device 5 for working the cleaning liquid 14 into the pores 17 of the fabric surface 16. The continued movement of the hemispherical tip 60 plurality of dimples 62 functions as a washboard for working the cleaning liquid 14 into the pores 17 of the fabric surface 16.

Figure 15:
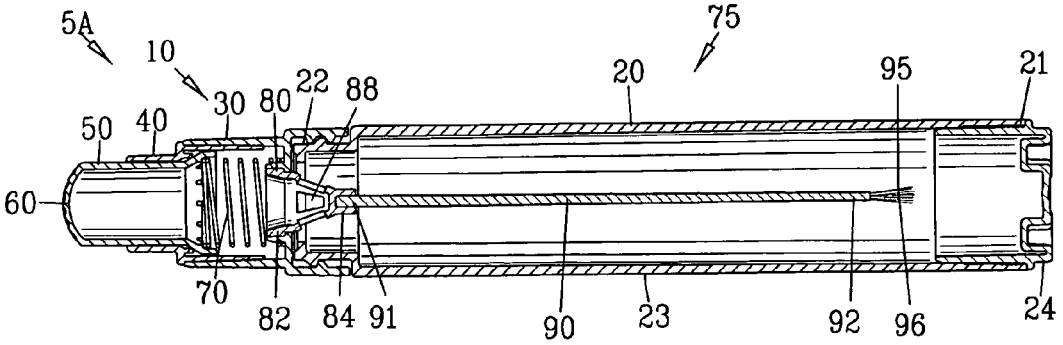
FIG. 15 is a side sectional view of a second embodiment of FIGS. 1-14 incorporating an internally stored alternate applicator.

FIG. 15 is a side sectional view of a second embodiment of a liquid applicator device 5A incorporating an internally stored alternate applicator 75. The liquid applicator device 5A is identical to the liquid applicator device 5 shown in FIGS. 1-14 except for the addition of the internally stored alternate applicator 75.

Figure 16:
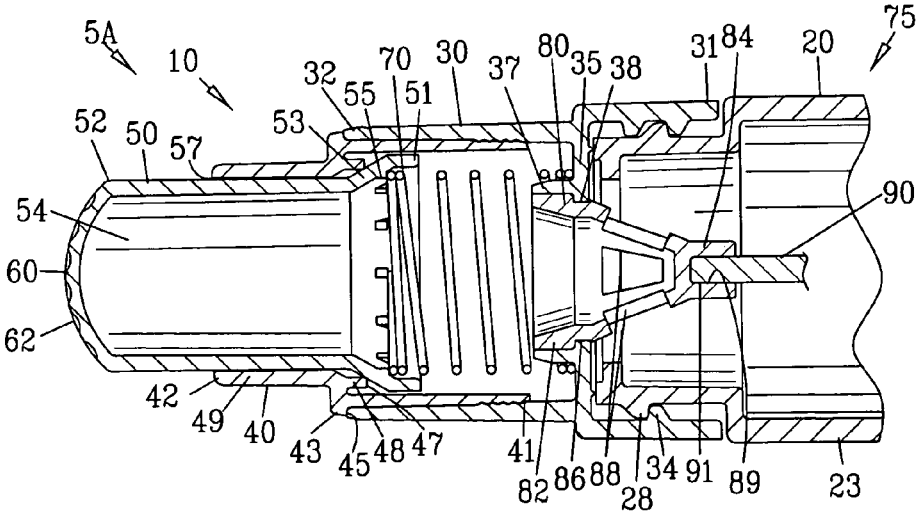
FIG. 16 is an enlarged view of a portion of FIG. 15.

FIG. 16 is an enlarged view of a portion of FIG. 15. The alternate applicator 75 comprises a generally conical shaped insert 80 defining an insert mounting 82 and an insert receiver 84. The insert mounting 82 is generally cylindrical shaped for insertion within the inner diameter of biasing base 37 of the closure 30. An annular detent 86 is defined within the insert mounting 82 for receiving the terminating edge of the transverse wall 35 defined by the closure aperture 38. Preferably, the detent 86 receives the terminal edge defined by the closure aperture 38 in a snap blocking engagement. The snap blocking engagement enables the insert 80 to be affixed to the closure 30 when the alternate applicator 75 is incorporated into the liquid applicator device 5A.

A plurality of apertures 88 are defined within the insert 80 for permitting liquid flow through the hollow insert 80. The plurality of apertures 88 enables the liquid 14 to flow from the liquid container 20 to the applicator 50 for operation as heretofore described.

The insert receiver 84 defines a bore 89 for receiving a first end 91 of a stem 90. Preferably, the first end 91 of the stem 90 is retained within the bore 89 by a press fit or frictional engagement. In the alternative, the first end 91 of the stem 90 may be affixed within the bore 89 by an adhesive, sonic welding or any other conventional means.

A secondary applicator 95 is affixed to the second end 92 of the stem 90. In this example, the secondary applicator 95 is shown as a small brush having bristles 96 secured within the second end 92 of the stem 90.

Figure 17:
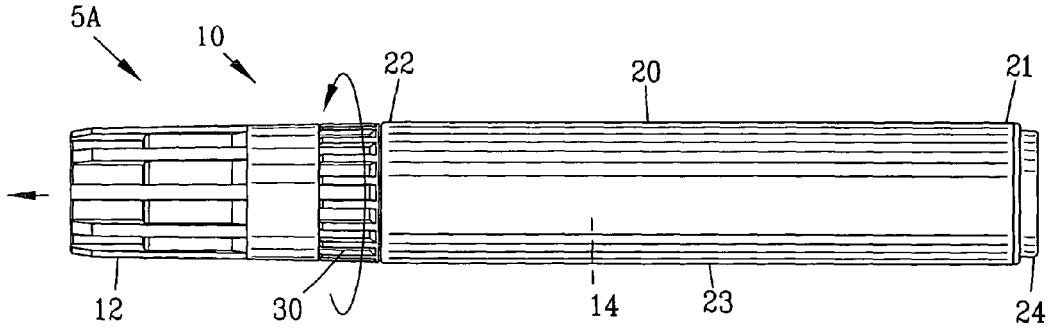
FIG. 17 is a side view of a liquid applicator device of FIGS. 15 and 16 with a protective cap covering an applicator tip.

FIG. 17 is a side view of a liquid applicator device 5A of FIGS. 15 and 16 with a protective cap 12 covering an applicator tip 50. The protective cap 12 is removably affixed to the closure 30 by either a friction sit or snap locking engagement.

Figure 18:
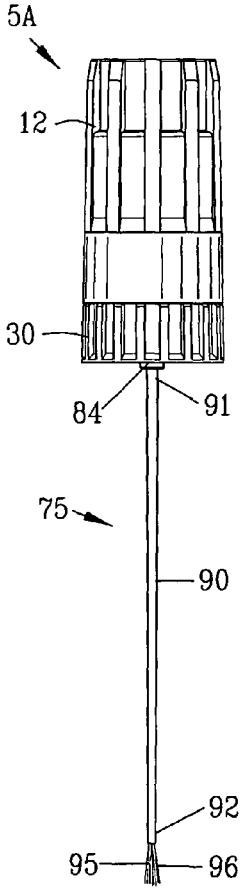
FIG. 18 is a side view illustrating removal of a closure including the protective cap for exposing the internally stored alternate applicator.

FIG. 18 is a side view illustrating removal of a closure 30 including the protective cap 12 for exposing the internally stored alternate applicator 75. The threads 34 of the closure 30 are unscrewed from the threads 28 of the container 20 exposes the internally stored alternate applicator 75. The protective cap 12 covers the applicator 50 to prevent disbursement of the liquid 14 from the applicator 50.

Figure 19:
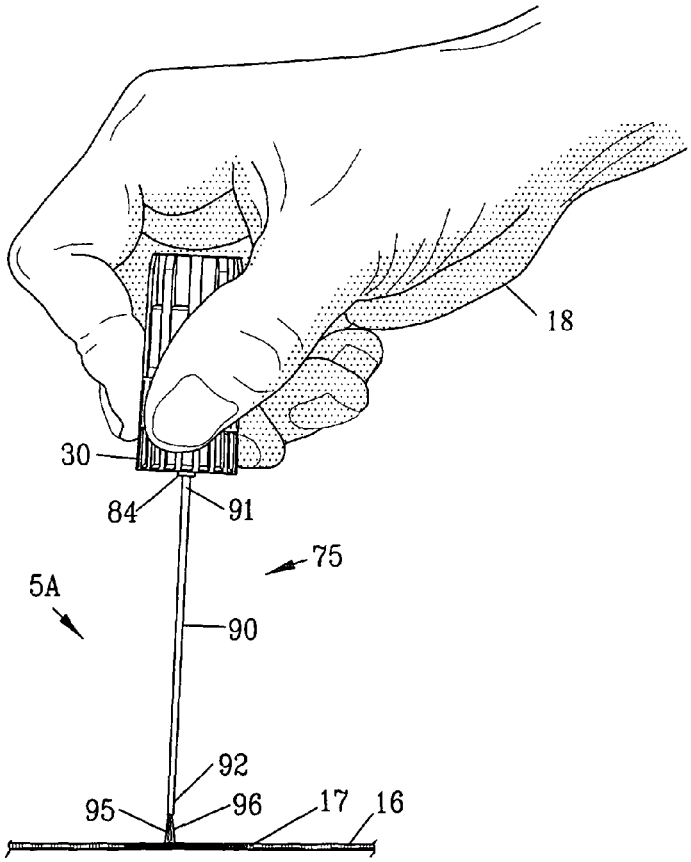
FIG. 19 is a side view of the internally stored alternate applicator dispensing the liquid.

FIG. 19 is a side view of the internally stored alternate applicator 75 dispensing the liquid 14 onto a surface 16. The bristles 96 of the secondary applicator 95 transfer of the liquid 14 onto the surface 16 in a conventional manner. The bristles 96 and be immersed within the container 20 to add more liquid to the alternate applicator 75 to be ultimately transferred to the surface 16. After use of the alternate applicator 75, the stem 90 is insert into the container 20 and the threads 34 of the closure 30 are screwed onto the threads 28 of the container 20 to reseal the liquid applicator device 5A. The liquid applicator device 5A permits the use of either the primary applicator 50 or the alternate applicator 75.

Figure 20:
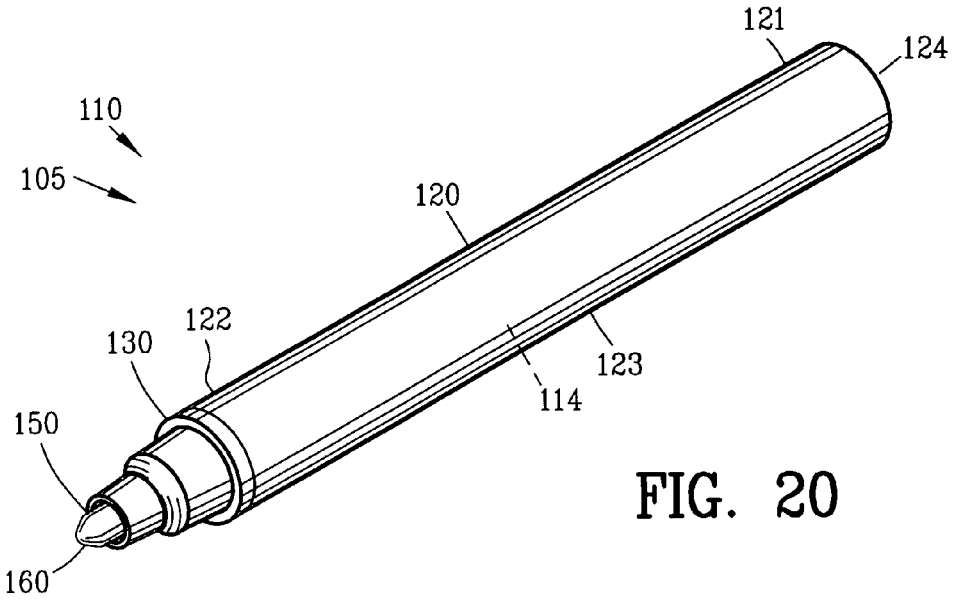
FIG. 20 is an isometric view of a third embodiment of a liquid applicator device of the present invention.
Figure 21:
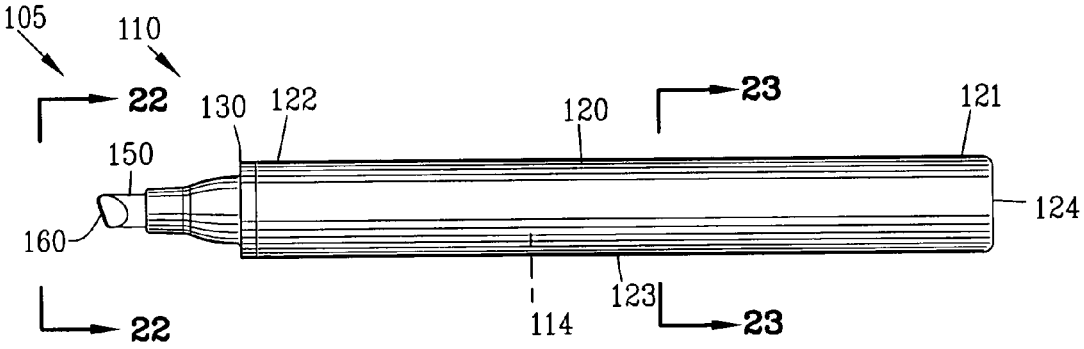
FIG. 21 is a side view of the liquid applicator device of FIG. 20

FIGS. 20 and 21 are isometric and side views of a third embodiment of a liquid applicator device 105 of the present invention. The liquid applicator device 105 comprises an applicator mechanism 110 for dispense a liquid 114 from a container 120. The container 120 extends between a first end 121 and a second end 122 defined by a sidewall 123.

The first end 121 and second end 122 terminate in a closed end wall 124 and an opening 127

Figure 22:
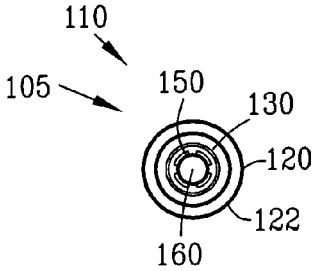
FIG. 22 is an enlarged sectional view along line 22-22 in FIG. 21.
Figure 23:
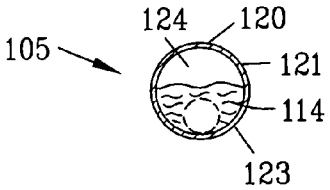
FIG. 23 is an enlarged sectional view along line 23-23 in FIG. 21.

FIGS. 22 and 23 are side sectional views of the liquid applicator device 105 of FIG. 21 illustrating the liquid 114 within the liquid applicator device 105. The liquid 114 is free to flow by action of gravity from the container 120 into the applicator mechanism 110.

Figure 24:
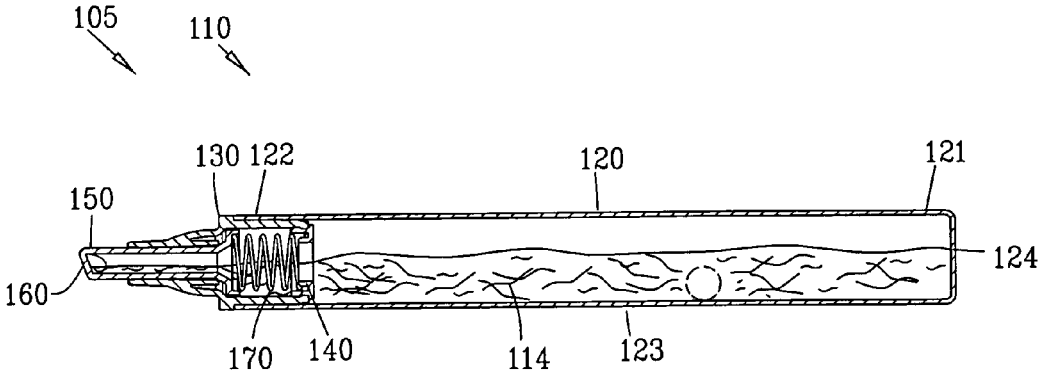
FIG. 24 is a side sectional view of the third embodiment of the liquid applicator device of FIGS. 20-24 with the applicator tip located in an extending position.

FIG. 24 is a side sectional view of the third embodiment of the liquid applicator device 105 of FIGS. 20-23. The applicator mechanism 110 comprises a closure 130, an end plug 140 and an applicator 150 defining an applicator tip 160. The applicator mechanism 110 further includes a biasing device 170 shown as a coil spring. The biasing device 170 urges the applicator 150 into an extended position as shown in FIGS. 24 and 25.

Figure 25:
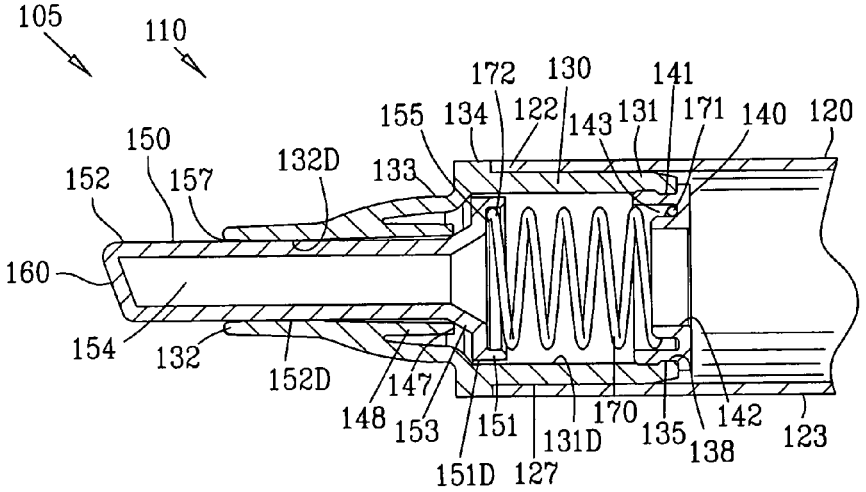
FIG. 25 is an enlarged view of a portion of FIG. 24.

FIG. 25 is an enlarged view of a portion of FIG. 24 with the liquid 114 removed from the liquid applicator device 105. In this example, the second end 122 of the container 120 receives the closure 130 by a press-fit engagement for securing the applicator mechanism 110 to the container 120.

The closure 130 extends between an inner portion 131 and an outer portion 132 with an intermediate portion 133 disposed therebetween. A stop 134 is located between the inner portion 131 and the outer portion 132 for engaging with the second end 122 of the container 120 to limit the depth of insertion of the closure 130 within the container 120.

The closure 130 includes an annular rim 135 defining a closure aperture 138 for providing a fluid path for the liquid 114 from the container 120 to the applicator 150. The inner portion 131 of the closure 130 defines any inner closure diameter 131D whereas the outer portion 132 of the closure 130 defines an outer closure diameter 132D. The diameter 131D of the inner portion 131 is greater than the diameter 132D of the outer portion 132. The intermediate portion 133 provides a taper between the diameter 131D and the diameter 132D.

An end plug 140 defines an annular detent 141 for receiving the annular rim 135 of the closure 130 for securing the end plug 140 the closure 130. The end plug 140 defines a through aperture 142 for permitting the flow of the liquid 114 from the container 120 to the inner portion 131 of the closure 130. The end plug 140 includes a recess 143 for receiving a first end 171 of the biasing member 170.

A sealing surface 147 is integrally formed with the closure 130. In this embodiment, an annular projection 148 extends axially toward the container 130. The annular projection 148 is coaxial with the diameter 131D of the inner portion 131 of the closure 130. The distal end of the annular projection 148 defines the sealing surface 147. The annular projection 148 extends axially away from the applicator tip 160 toward the container 120.

The applicator 150 has an inner applicator portion 151 and an outer applicator portion 152 with an intermediate applicator portion 153 located therebetween. The inner applicator portion 151 of the applicator 150 defines an inner applicator diameter 151D whereas the outer applicator portion 152 of the applicator 150 defines an outer applicator diameter 152D. The intermediate portion 153 is interposed between the inner applicator diameter 151D and the outer applicator diameter 152D to form an angularly disposed intermediate portion 153 for sealing engaging with the sealing surface 147.

The applicator 150 is a generally hollow shell defining hollow interior 154. A distal end of the outer applicator portion 152 of the applicator 150 forms the applicator tip 160. A biasing retainer 155 is located in the applicator 150. The biasing retainer 155 provides a mounting for receiving a second end 172 of the biasing member 170.

The applicator 150 is located within the closure 130 with the inner applicator portion 151 and the intermediate applicator portion 153 being located adjacent to the intermediate portion 133 of the closure 130. The outer applicator portion 152 is disposed within the outer portion 132 of the closure 130.

The outer applicator portion 152 of the applicator 150 and the outer portion 132 of the closure 130 define a passageway 157 therebetween for enabling the flow of liquid therethrough. The diameter 132D of the outer portion 132 of the closure 130 and the diameter 152D of the outer applicator portion 152 of the applicator 150 are selected to provide the optimum passageway 157 for the viscosity of the liquid 114.

Figure 26:
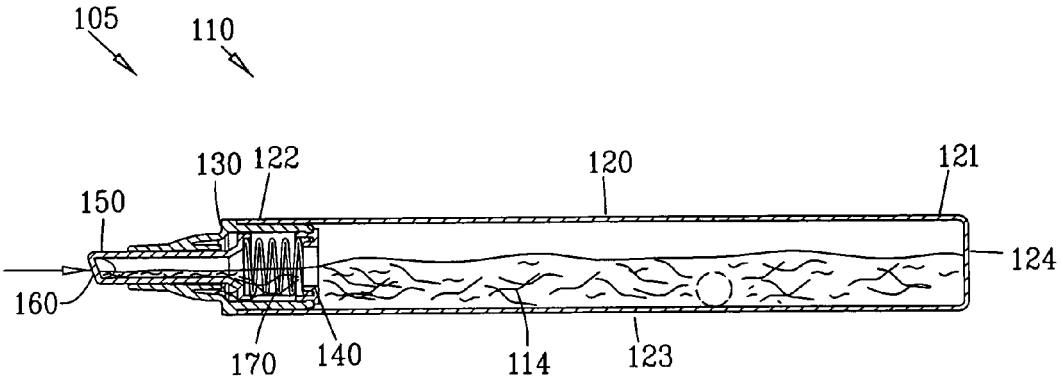
FIG. 26 is a view similar to FIG. 24 with the applicator tip displaced into a retracted position.
Figure 27:
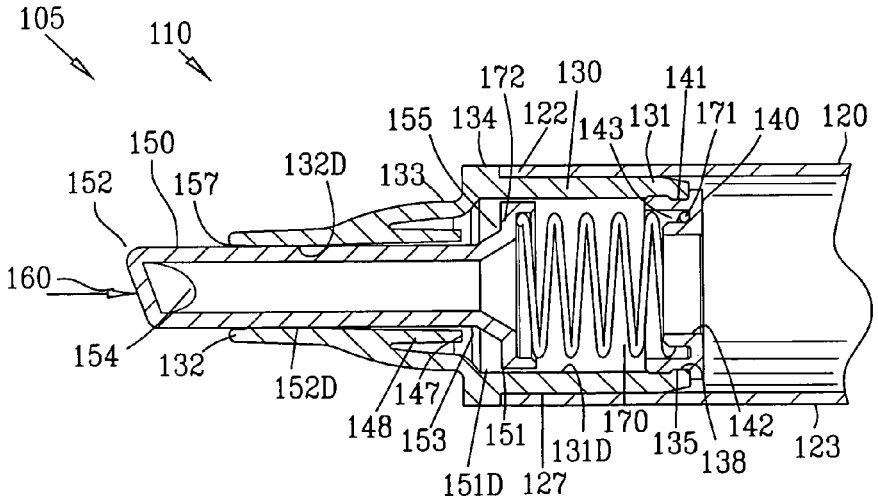
FIG. 27 is an enlarged view of a portion of FIG. 26.

The applicator 150 is slidable between the extended position as shown in FIGS. 24-25 and a retracted position as shown in FIGS. 26-27. The biasing member 170 coacts between the closure 130 and the applicator 150 for urging the applicator 150 into the extended position as shown in FIGS. 24-25 to form a seal with the closure 130.

The seal is formed by the biased engagement of the angularly disposed intermediate portion 153 of the applicator 150 against the sealing surface 147 located in the distal end of the annular projection 148. The seal inhibits the flow of the liquid 114 from the container 120 to the outer applicator portion 152 of the applicator 150.

FIGS. 26 and 27 are views similar to FIGS. 24 and 25 with the applicator 150 displaced into the retracted position. The movement of the applicator 150 into the retracted position displaces the angularly disposed intermediate portion 153 of the applicator 150 from engaging with the sealing surface 147 located in the distal end of the annular projection 148 to permit the flow of the liquid 114 from the container 120 to the outer applicator portion 152 of the applicator 150.

Figure 28:
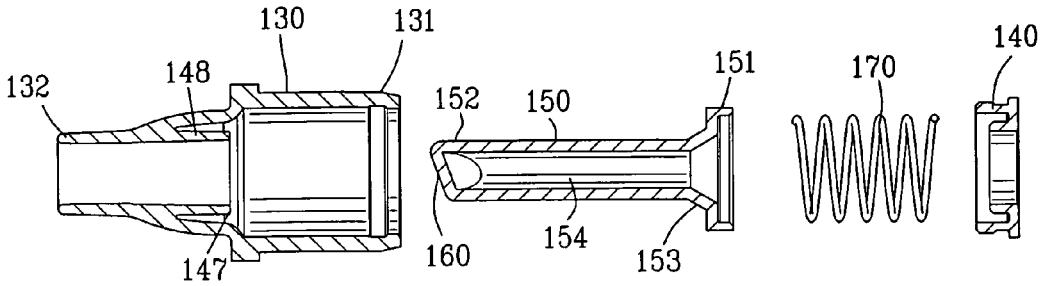
FIG. 28 is an exploded view of the liquid applicator device of FIGS. 20-27.

FIG. 28 is an exploded view of the liquid applicator device of FIGS. 20-27. The component parts including the closure 130, the end plug 140, the unitary applicator 150 with tip 160 and the biasing member 170 are shown in an aligned position.

Figure 29:
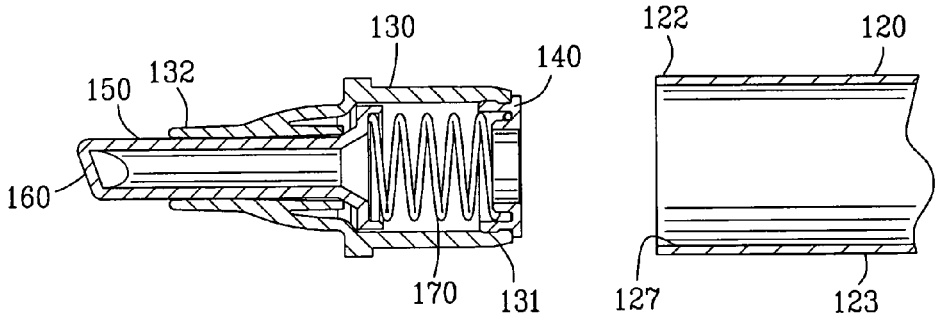
FIG. 29 is a first step in the process of assembling the liquid applicator device of FIGS. 20-27 illustrating the insertion of an applicator tip and a spring into a closure of the liquid applicator device and the installation of a retainer.

FIG. 29 is a first step in the process of assembling the liquid applicator device 105 of FIGS. 20-27 illustrating the insertion of the applicator 150 and the biasing member 170 into the closure 130 and the installation of the end plug 140.

Figure 30:
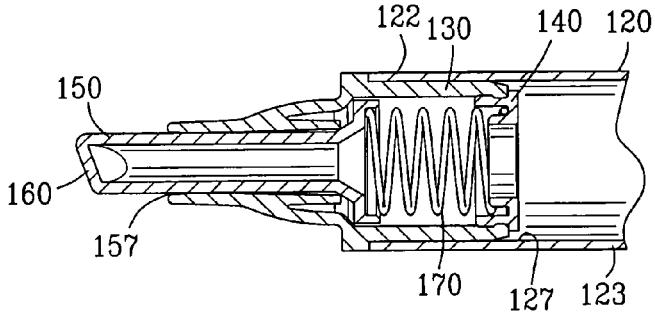
FIG. 30 is a second step in the process of assembling the liquid applicator device of FIGS. 20-27 illustrating the affixing of the liquid applicator device to a liquid container.

FIG. 30 is a second step in the process of assembling the liquid applicator device 105 of FIGS. 20-27 illustrating the affixing of the liquid applicator device 105 to the liquid container 120. The tapered outer diameter of the closure 130 is inserted into the opening 127 of the container 120 to join the closure 130 to the container 120.

Figure 31:
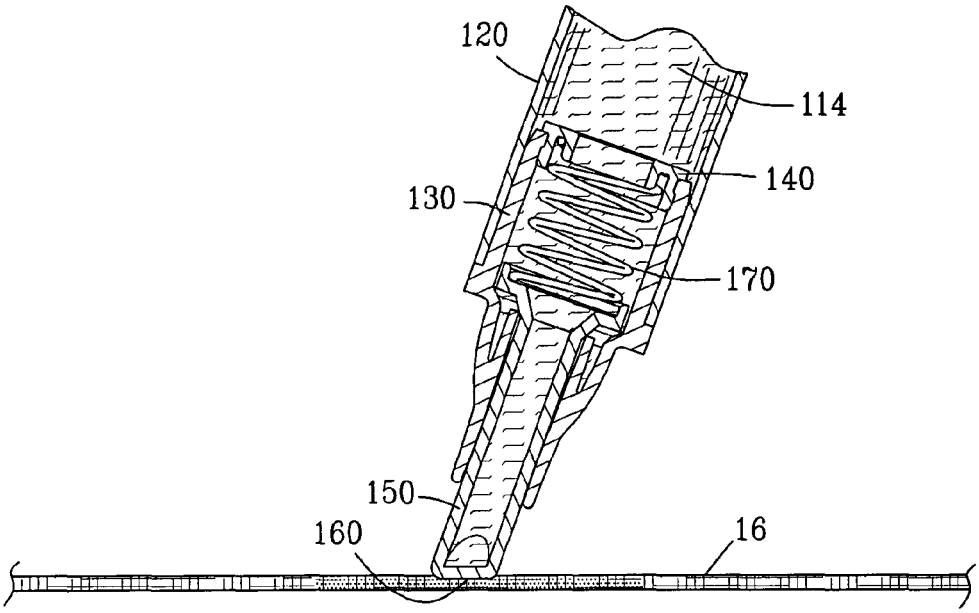
FIG. 31 is an enlarged view of a portion of FIG. 26 illustrating the liquid applicator device positioned over a surface.

FIG. 31 is a view of the liquid applicator device 105 positioned over a surface 116. The biasing member 170 inhibits the flow of liquid 114 to the applicator tip 160

Figure 32:
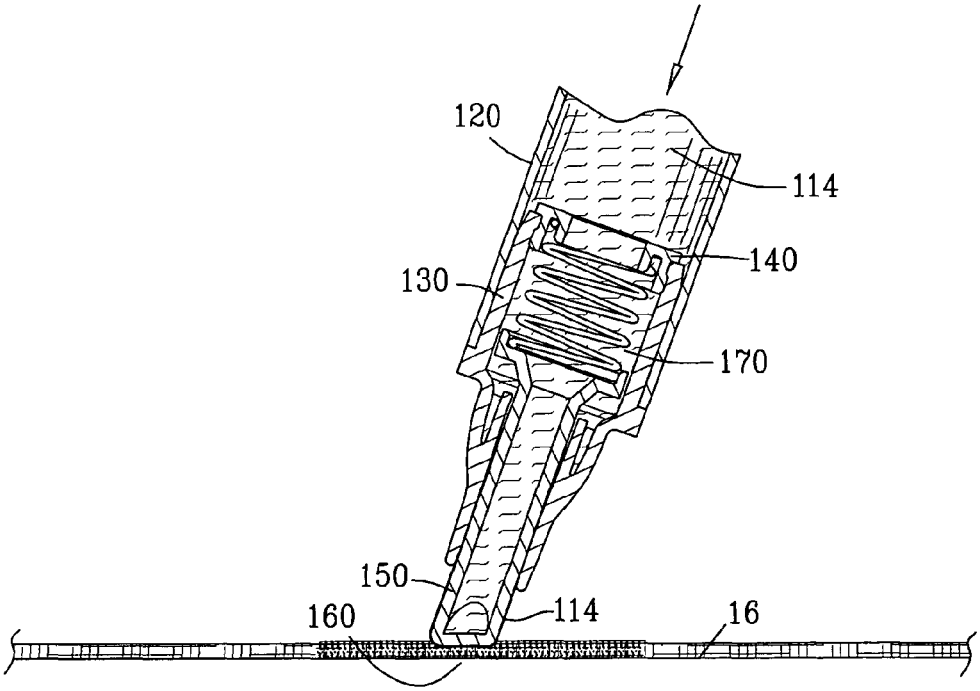
FIG. 32 is a view similar to FIG. 31 illustrates the liquid applicator device impressed against a surface.

FIG. 32 is a view of the liquid applicator device 105 impressed against the surface 116. A depression of the applicator tip 160 against the surface 116 displaces the applicator 150 from the sealing surface 147 to enable the flow of the liquid 114 from the container 120 to the applicator tip 160 of the applicator 150.

The liquid 114 flows by action of gravity from the container 120 around the sealing surface 147 to enter the passageway 157 between the outer applicator portion 152 of the applicator 150 and the outer portion 132 of the closure 130.

The liquid applicator devices of the present invention have the advantage that the applicator may not be removed from the outer portion of the closure. The enlarged dimension of the inner portion of the applicator prevents the applicator from being removed from the outer portion of the closure.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A liquid applicator device for applying a liquid from a container to a surface, comprising;

a closure having closure mounting for securing said closure to the container;

said closure defining a closure aperture extending therethrough;

a unitary sealing member comprising an inner sealing member portion and an outer sealing member portion with an intermediate sealing member portion disposed therebetween;

said inner sealing member portion of said sealing member sealingly engaging with said closure;

said outer sealing member portion of said sealing member having a tubular sleeve;

said intermediate sealing member portion of the sealing member comprising an annular projection unitary with said sealing member extending axially toward the inner sealing member portion and coaxial with said inner sealing member portion;

a distal end of the annular projection defining said sealing surface;

an applicator including an inner applicator portion, an intermediate applicator portion and an outer applicator portion;

said intermediate applicator portion being angularly disposed for engaging with said sealing surface for inhibiting the flow of the liquid from the container to said outer applicator portion when said intermediate applicator portion engages with said sealing surface;

an applicator tip defined, by said outer applicator portion of said applicator;

said applicator tip defining a generally hemispherical distal end having a plurality of dimples;

said outer applicator portion of said applicator slidably disposed within said tubular sleeve of said sealing member for movement between an extended position and a retracted position;

a biasing member coacting between said closure and said applicator for urging said applicator into said extended position for forming a seal between said sealing surface and said applicator; and a depression of said outer applicator portion against the surface displacing said applicator from said extended position to said retracted position to displace said applicator from said sealing surface to enable the flow of the liquid from the container to said applicator tip of said outer applicator portion of said applicator.

2. A liquid applicator device as set forth in claim 1, including a biasing base extending from said closure into said closure aperture defining a spring retaining step.

3. A liquid applicator device as set forth in claim 1, wherein said biasing member comprises a spring coacting between a spring step located within said closure and said applicator for biasing said applicator into sealing engagement with said sealing surface of said closure for inhibiting the flow of the liquid from the container.

4. A liquid applicator device as set forth in claim 1, wherein said inner applicator portion of said applicator defines an inner applicator diameter;

said outer applicator portion of said applicator defining an outer applicator diameter;

said inner applicator diameter being greater than said outer applicator diameter; and said angularly disposed intermediate portion interposed between said inner applicator diameter and said outer applicator diameter.

5. A liquid applicator device as set forth in claim 1, wherein said applicator is substantially hollow shell.

6. A liquid applicator device as set forth in claim 1, including an alternate applicator secured to said closure and located within the container.

7. A liquid applicator device for applying a liquid from a container to a surface; comprising;

a closure having closure mounting for securing said closure container;

said closure defining a closure aperture extending therethrough;

a unitary sealing member comprising an inner sealing member portion and an outer sealing member portion with an intermediate sealing member portion disposed therebetween;

said inner sealing member portion of said sealing member sealingly engaging with said closure;

said outer sealing member portion of said sealing member having a tubular sleeve;

said intermediate sealing member portion of the sealing member comprising an annular projection unitary with said sealing member extending axially toward the inner sealing member portion and coaxial with said inner sealing member portion;

a distal end of the annular projection defining said sealing surface;

an applicator including an inner applicator portion, an intermediate applicator portion and an outer applicator portion;

said intermediate applicator portion being angularly disposed for engaging with said sealing surface for inhibiting the flow of the liquid from the container to said outer applicator portion when said intermediate applicator portion engages with said sealing surface;

an applicator tip defined by said outer applicator portion of said applicator;

said applicator comprising a hollow interior with an applicator tip defined by an outer applicator portion of said applicator;

said outer applicator portion of said applicator slidably disposed within said tubular sleeve of said sealing member for movement between an extended position and a retracted position;

a biasing member coacting between said closure and said applicator for urging said applicator into said extended position for forming a seal between said sealing surface and said applicator; and a depression of said outer applicator portion against the surface displacing said applicator from said extended position to said retracted position to displace said applicator from said sealing sin face to enable the flow of the liquid from the container to said applicator tip of said outer applicator portion of said applicator.

8. A liquid applicator device as set forth in claim 7, including a biasing as extending from said closure into said closure aperture defining a spring retaining step.

9. A liquid applicator device as set forth in claim 7, wherein said biasing member comprises a spring coacting between a spring step located within said closure and said applicator for biasing said applicator into sealing engagement with said sealing surface of said closure for inhibiting the flow of the liquid from the container.

10. A liquid applicator device as set forth in claim 7, wherein said inner applicator portion of said applicator defines an inner applicator diameter;

said outer applicator portion of said applicator defining an outer applicator diameter;

said inner applicator diameter being greater than said outer applicator diameter; and said angularly disposed intermediate portion interposed between said inner applicator diameter and said outer applicator diameter.

11. A liquid applicator device as set forth in claim 7, wherein said outer applicator portion of said applicator defines said applicator tip having a generally hemispherical distal end.

12. A liquid applicator device as set forth in claim 7, wherein said outer applicator portion of said applicator defines said applicator tip having a generally hemispherical distal end; and said generally hemispherical distal end having a plurality of dimples.

13. A liquid applicator device as set forth in claim 7, including an alternate applicator secured to said closure and located within the container.

14. A liquid applicator device for applying as liquid from a container to a surface, comprising;

a closure having closure mounting for securing said closure to the container;

said closure defining a closure aperture extending therethrough;

member portion with an intermediate sealing member portion disposed therebetween;

said inner sealing member portion of said sealing member sealingly engaging with said closure;

said intermediate sealing member portion of the sealing member comprising an annular projection unitary with said sealing member extending axially toward the inner sealing member portion and coaxial with said inner sealing member portion;

a distal end of the annular projection defining said sealing surface;

said outer sealing member portion of said sealing member having a tubular sleeve;

an applicator having an inner applicator portion, an intermediate applicator portion and an outer applicator portion;

said intermediate applicator portion being angularly disposed for engaging with said sealing surface for inhibiting the flow of the liquid from the container to said outer applicator portion when said intermediate applicator portion engages with said sealing surface;

an applicator tip defined by said outer applicator portion of said applicator;

said outer applicator portion of said applicator slidably disposed within said tubular sleeve of said sealing member for movement between an extended position and a retracted position;

a biasing member coacting between said closure and said applicator for urging said applicator into said extended position for forming, a seal between said sealing surface and said applicator; and a depression of said outer applicator portion against the surface displacing said applicator from said extended position to said retracted position to displace said applicator from said sealing surface to enable the flow of the liquid from the container to said applicator tip of said outer applicator portion of said applicator; and an alternate applicator secured to said closure and located within the container.

* * * * *